US008779257B2

(12) United States Patent
Barnes

(10) Patent No.: US 8,779,257 B2
(45) Date of Patent: Jul. 15, 2014

(54) STRINGED INSTRUMENT

(76) Inventor: Edward D. Barnes, Port Hadlock, WA (US)

( * ) Notice: Subject to any disclaimer, the term of this patent is extended or adjusted under 35 U.S.C. 154(b) by 208 days.

(21) Appl. No.: 13/295,919

(22) Filed: Nov. 14, 2011

(65) Prior Publication Data

US 2012/0144972 A1 Jun. 14, 2012

Related U.S. Application Data

(60) Provisional application No. 61/413,668, filed on Nov. 15, 2010.

(51) Int. Cl.
*G10D 3/10* (2006.01)

(52) U.S. Cl.
USPC ..... 84/297 R

(58) Field of Classification Search
USPC ..... 84/267, 290, 293
See application file for complete search history.

(56) References Cited

U.S. PATENT DOCUMENTS 4,846,038 A * 7/1989 Turner ..... 84/293

OTHER PUBLICATIONS http://web.archive.org/web/20100924072944/http://www.stewmac.com/shop/Accessories/Capos,_slides/5th_String_Capo_Spikes.html Date: Sep. 24, 2010.*

* cited by examiner

*Primary Examiner* — Kimberly Lockett
(74) *Attorney, Agent, or Firm* — Drinker Biddle & Reath LLP

(57) ABSTRACT

A stringed instrument has a body, a neck connected to the body, strings extending from the body to a distal end of the neck, frets on the neck under the strings, and at least one spike between two of the frets and under at least one of the strings. The strings are arranged so that the thickest string and the thinnest string are adjacent to each other.

14 Claims, 53 Drawing Sheets

The relationship and tuning is now this:

STRINGED INSTRUMENT

CROSS REFERENCE TO RELATED PATENT APPLICATION

This application claims the benefit under 35 U.S.C. §119 (e) of U.S. Provisional Patent Application No. 61/413,668, filed on Nov. 15, 2010, the entire disclosure of which is incorporated herein by reference.

TECHNICAL FIELD

The present disclosure relates to a stringed musical instrument. More particularly, the present disclosure relates to a stringed musical instrument that is adapted to provide sound substantially similar to, at least, an acoustic, electric, or other guitar; a banjo; or some combination of the aforementioned.

BACKGROUND

In the discussion of the background that follows, reference is made to certain structures and/or methods. However, the following references should not be construed as an admission that these structures and/or methods constitute prior art. The inventor expressly reserves the right to demonstrate that such structures and/or methods do not qualify as prior art.

There are several stringed instruments, and each have a unique sound. However, no one stringed instrument can provide access to the distinct range of sounds of one or more of these stringed instruments in the manner of the present invention. Accordingly, there is a need in the art for a stringed instrument in accordance with the present invention that provides access to one or more sounds of other stringed instruments in one instrument.

SUMMARY

An exemplary stringed instrument comprises a body, a neck connected to the body, strings extending from the body to a distal end of the neck, frets on the neck under the strings, and at least one spike between two of the frets and under at least one of the strings. In the exemplary stringed instrument, the strings are arranged so that the thickest string and the thinnest string are adjacent to each other.

It is to be understood that both the foregoing general description and the following detailed description are exemplary and explanatory and are intended to provide further explanation of the invention as claimed.

BRIEF DESCRIPTION OF THE DRAWINGS

The following detailed description can be read in connection with the accompanying drawings in which like numerals designate like elements and in which.

DETAILED DESCRIPTION

Figure 1:
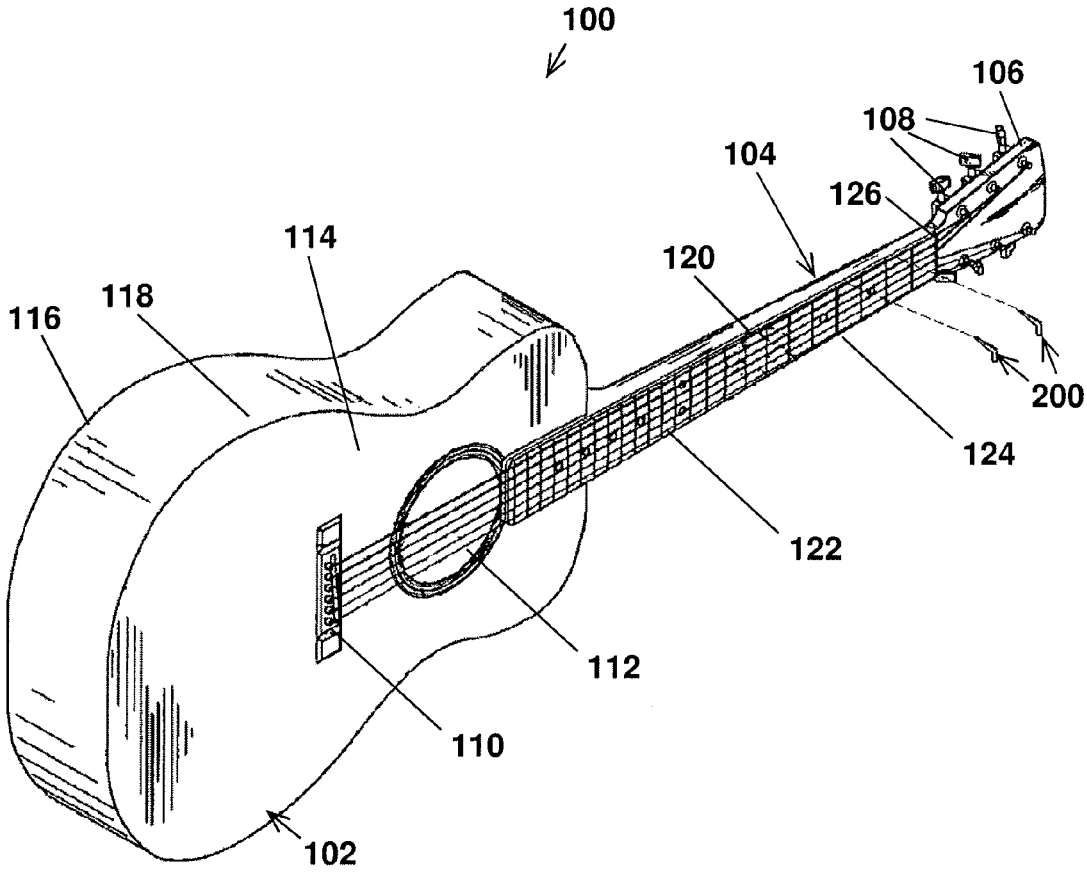
FIG. 1 is a front perspective, partially exploded view of a stringed instrument in accordance with an embodiment of the invention.

Referring to the figures, the stringed instrument 100 is adapted to produce a range of sounds including, for example, at least a portion of a range of sounds that can be produced from at least two other stringed instruments. In the embodiment of FIG. 1, the stringed instrument 100 is able to produce at least a portion of the range of sounds from an acoustic guitar and a banjo. In an alternative construction, the stringed instrument 100 is able to produce at least a portion of the range of sounds from an electric guitar and a banjo. On the other hand, the ability to produce at least a portion of the range of sounds from multiple instruments is not an essential feature of the present invention.

Figure 2:
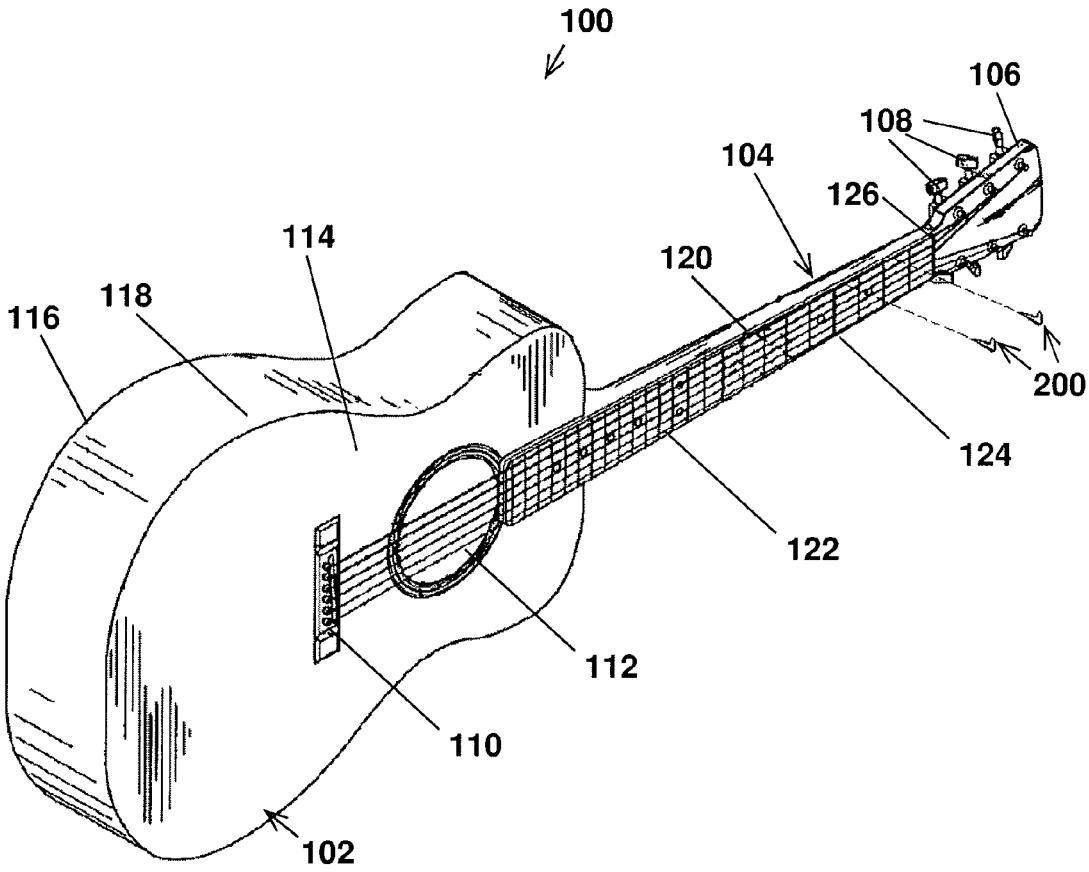
FIG. 2 is a front perspective, partially exploded view of a stringed instrument with spikes of an alternate construction.
Figure 3:
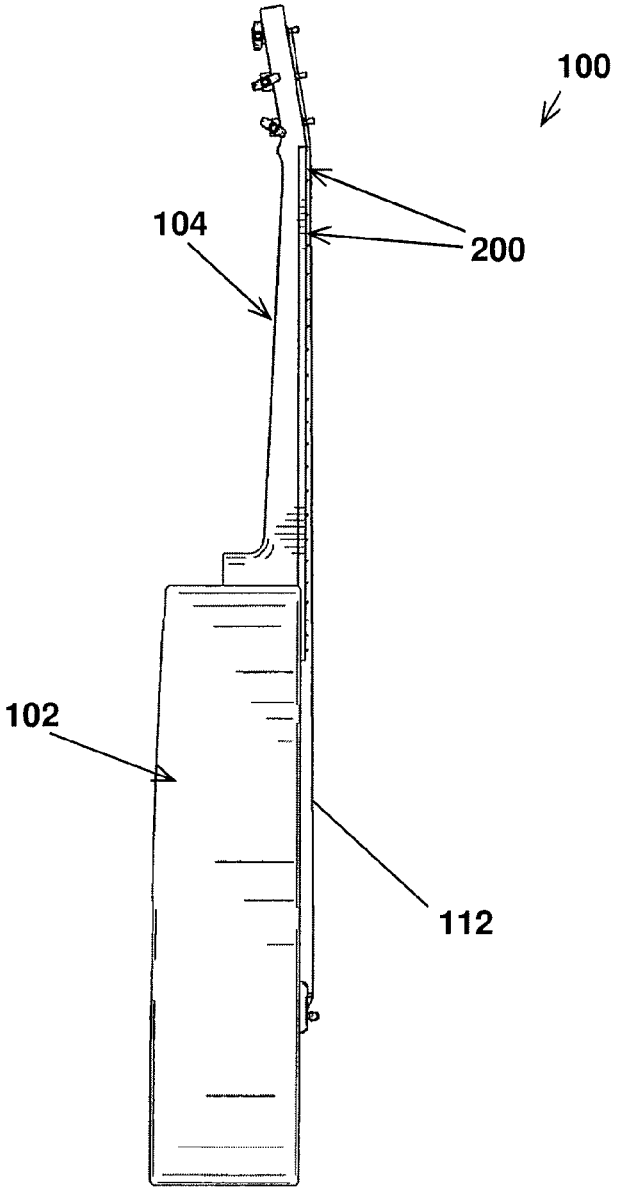
FIG. 3 is a side elevational view of the stringed instrument shown in FIG. 1.

Turning to FIGS. 1, 2 and 3, the exemplary embodiment of the stringed instrument 100 includes a body 102, a neck 104 coupled to the body 102, and a headstock 106 coupled to the neck 104 at an end of the neck 104 opposite from the body 102. The headstock 106 includes one or more tuners 108, and a bridge 110 is on the body 102. At least one string 112 extends from the one or more tuners 108 to the bridge 110 on the body 102.

The body 102 includes a top surface 114, a bottom surface 116, at least one side surface 118, and a hollow formed between the top surface 114, the bottom surface 116, and the at least one side surface 118. The body 102 can also include one or more bracing members (not shown) to provide further structural support to the top surface 114, the bottom surface 116, the at least one side surface 118, or some combination of the aforementioned.

The top surface 114 can also be referred to as the soundboard. In the embodiment shown, the top surface 114 can be substantially planar and shaped generally similar to a figure eight. The top surface 114 can also be made from tone woods such as spruce or cedar. However, the top surface 114 can have some other suitable shape or can be made from any suitably rigid material. Also, the top surface 114 can be about 2 mm to 3 mm thick and strengthened by at least one bracing member.

In the embodiment shown in FIGS. 1 and 2, the bottom surface 116 is substantially planar and shaped generally similarly to the top surface 114. The bottom surface 116 is substantially parallel to the top surface 114 and spaced apart from the top surface 114. The at least one side surface 118 extends between outermost peripheries of the top surface 114 and the bottom surface 116. The bottom surface 116 and the at least one side surface 118 can be made from timbers such as mahogany, Indian rosewood and Brazilian rosewood or *Dalbergia nigra*. Also, the material for the bottom surface 116 and the at least one side surface 118 can be chosen for aesthetic purposes, but the material for the bottom surface 116 and the at least one side surface 118 can be any suitably rigid material. Furthermore, the bottom surface 116 and the at least one side surface 118 can be decorated with inlays and purfling.

The neck 104 is coupled to the body 102 and extends away from the body 102. In the embodiment shown, the neck 104 is generally tubular with at least one planar surface 120. The neck 104 as shown in the figures is coupled to the top surface 114 and the at least one side surface 118 of the body 102 so that the neck 104 extends from the top of the generally figure eight shape of the top surface 114 and so that the at least one planar surface 120 of the neck 104 is generally parallel to the top surface 114 of the body 102. The neck 104 may be coupled to the body 102 by a chemical coupling, such as glue, adhesive, and the like; a mechanical coupling, such as a bolt, interlocking mechanical parts, and the like; or some combination of the aforementioned. The neck 104 can be made from wood. However, the neck 104 can be made from any suitably rigid material that can resist bending or bending stresses caused by, at least, the stretching of the plurality of strings 112 from the headstock 106 to the body 102. For example, the neck 104 can be made from graphite, carbon fiber, metal such as aluminum, alloy such as titanium alloy, or some combination of these materials. Also, a truss rod can be disposed within the neck 104 so that the neck 104 can better resist bending and bending stresses caused by, at least, one of the plurality of strings 112.

A fretboard 122 is disposed on the at least one planar surface 120 of the neck 104, and the plurality of strings 112 extend over the fretboard 122. The fretboard 122 can also be called a fingerboard. The fretboard 122 is generally planar, but in some embodiments, the fretboard 122 can include an arch, where the arch extends generally transverse to a longitudinal length of the neck 104. The curvature of the arch of the fretboard 122 is called a fretboard radius, and the fretboard radius is based on the radius of a hypothetical circle that includes a segment that coincides with the arch of the fretboard 122. Thus, the smaller the fretboard radius, the more curved the arch of the fretboard 122 is. The fretboard 122 can be made from wood, such as rosewood, ebony, or maple, or any other suitably rigid material, such as manufactured or composite materials such as high pressure laminate or resin. In the embodiment shown in the figures, the fretboard 122 is made from wood.

The fretboard 122 can also include at least one fret 124. In the embodiment shown in FIGS. 1, 2, and 3, there are 24 frets 124. However, the exact number of frets 124 is not meant to limit the invention. Alternatively, there may be from nineteen frets 124 to twenty seven frets 124. The at least one fret 124 is disposed on the fretboard 122 generally transverse to the longitudinal length of the neck 104 so that the at least one fret 124 is disposed substantially transverse to at least a portion of the plurality of strings 112 that extend over the fretboard 122. The at least one fret 124 is disposed on the fretboard 122 so that it divides a scale length of at least one of the plurality of strings 112. Thus, pressing at least one of the plurality of strings 112 against the at least one fret 124 changes the vibrating length of the at least one of the plurality of strings 112 and therefore its resultant pitch. Also, a plurality of frets 124 can be disposed on the fretboard 122 so that, when at least one of the plurality of strings 112 is pressed against one of the plurality of frets 124, the vibrating length of the at least one of the plurality of strings 112 generally correlates to equal tempered divisions of an octave. Also, the plurality of frets 124 can be disposed on the fretboard 122 so that the pitch of at least one of the plurality of strings 112, when pressed against at least one of the plurality of frets 124, is at a half-step interval on a chromatic scale. Furthermore, a ratio of spacing between two consecutive frets 124 can be the twelfth root of two; thus the twelfth fret divides the scale length in two halves, and the twenty-fourth fret divides the scale length in half again. Also, every twelve frets 124 can correlate to one octave. The at least one fret 124 is made from a suitably rigid material, such as metal like nickel alloy or stainless steel, or can be made integrally with the fretboard 122. The fret 124 can have a thickness, width, or gauge in accordance with the preference of the player.

The headstock 106 is located at the end of the neck 104 farthest from the body 102. The headstock 106 includes at least one tuner 108, which can also be referred to as a machine head, peghead, tuning key, or tuning machine. At least one of the plurality of strings 112 is coupled to the at least one tuner 108. The at least one tuner 108 adjusts the tension of the at least one of the plurality of strings 112, which in turn affects the pitch of the at least one of the plurality of strings 112. Thus, each of the plurality of strings 112 can be connected to a respective one of a plurality of tuners 108 so that the pitch of each of the plurality of strings 112 can be adjusted by one of the plurality of tuners 108. In the embodiment shown in the figures, the headstock 106 includes six tuners 108, with three tuners 108 being disposed generally symmetrically on each side of the headstock 106. However, the tuners 108 can be disposed in some other layout on the headstock 106, such as six in line tuners 108 or four tuners 108 on one side and two tuners 108 on the other side. In other constructions, there may be no headstock 106 so that the tuners 108 are located elsewhere, such as on the body 102 or a bridge 110 on the body 102.

The nut 126 is disposed near the coupling of the headstock 106 to the neck 104. The nut 126 includes a plurality of grooves, each of the plurality of grooves is sized to receive one of the plurality of strings 112. Thus, a larger groove receives a thicker one of the plurality of strings 112, and a smaller groove receives a thinner one of the plurality of strings 112. The grooves should hold the plurality of strings 112 tightly so that the plurality of strings 112 do not slip or cause string buzz. The plurality of grooves guides the strings 112 onto the fretboard 122 and provides consistent spacing between adjacent strings 112. The nut 126 can also be an endpoint for the vibrating length of at least one of the plurality of strings 112 or all of the plurality of strings 112.

Some or all of the plurality of strings 112 extend from their respective plurality of tuners 108 to the bridge 110 disposed on the top surface 114 of the body 102. The bridge 110 holds some or all of the plurality of strings 112 in place on the body 102. The bridge 110 can include another mechanism for raising or lowering one, some, or all of the plurality of strings 112, either simultaneously or individually. Also, the bridge 110 can adjust the distance between at least two of the plurality of strings 112, adjust the distance between one or more of the plurality of strings 112 and the fretboard 122, or fine tune one or more of the plurality of strings 112. Furthermore, the bridge 110 may be spring loaded, include a removable arm, or some other apparatus that allows a user to modulate the pitch of the plurality of strings 112 by moving the bridge 110 towards or away from the headstock 106. The bridge 110 transfers the vibration from the plurality of strings 112 to the top surface 114 or the soundboard, which vibrates the air inside of the stringed instrument 100, thereby amplifying the sound produced by the strings 112.

Each of the plurality of strings 112 is adapted to vibrate to produce a sound. Each of the plurality of strings 112 can have a different diameter or thickness so that each of the plurality of strings 112 produces a different sound. There may be four to eighteen strings 112, however the exact number of strings 112 is not meant to limit the invention. The plurality of strings 112 can be made from gut strings, polymer materials such as nylon or fluorocarbon, metal such as steel or nickel, alloy such as steel alloy or phosphor bronze, animal product material, plant product material, or some combination of the aforementioned. Also, the plurality of strings 112 may be made from material that has been wound to form a coil that is stretched from the headstock 106 to the body 102, rather than a long, straight-running fiber that is stretched from the headstock 106 directly to the body 102.

Figure 4:
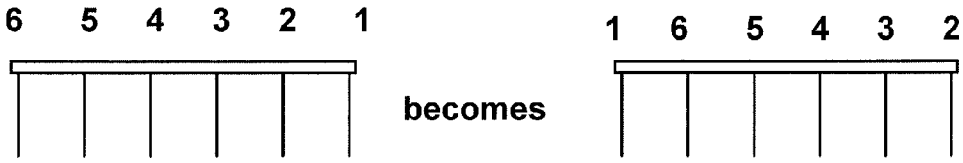
FIG. 4 is a schematic illustrating a string arrangement for a stringed instrument in accordance with an embodiment of the invention.
Figure 4:
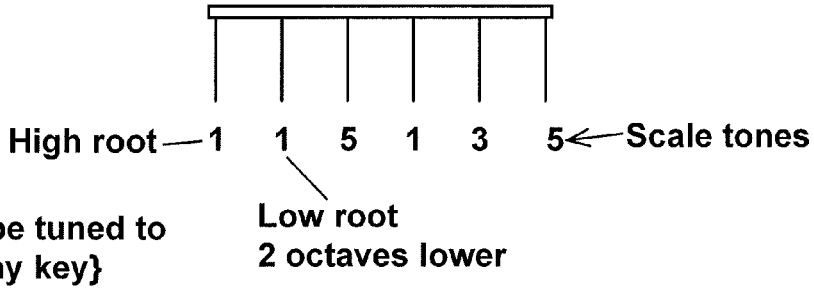
Figure 4:
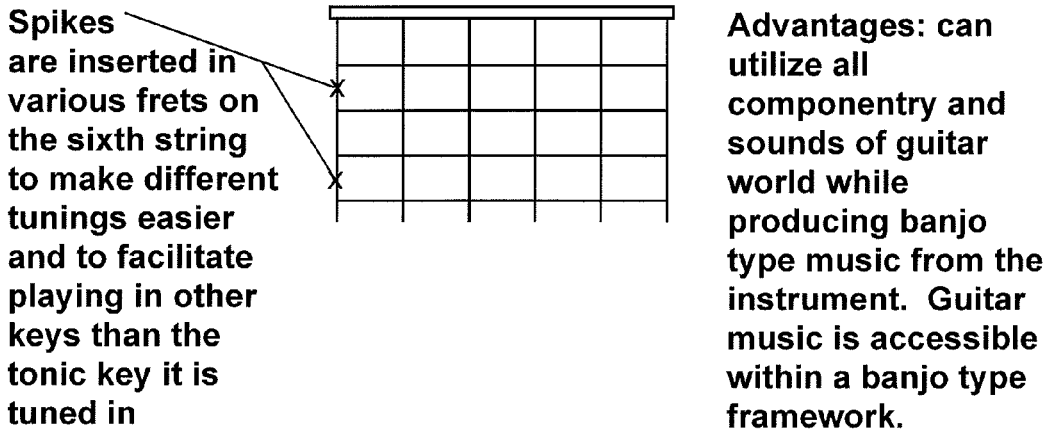

Referring to FIG. 4, a stringed instrument 100 made from an electric guitar is shown to explain the arrangement of the plurality of strings 112 of the stringed instrument 100. The plurality of strings 112 are rearranged so that one of the outermost strings 112 is moved from one side of the neck 104 to an opposite side of the neck 104 and the remaining strings 112 are repositioned one space over. In particular, for the depicted embodiment, there are six strings 112 that were disposed in the order 6-5-4-3-2-1. The depicted outermost strings 6 and 1 are "E" keys approximately two octaves apart. String 1 is moved to the position previously occupied by string 6. String 6 moves to the space previously occupied by string 5. String 5 moves to the space previously occupied by string 4. String 4 moves to the space previously occupied by string 3. String 3 moves to the space previously occupied by string 2. String 2 moves to the space previously occupied by string 1. Thus, after rearranging the plurality of strings 112, the new order of the plurality of strings 112 is 1-6-5-4-3-2. String 6 and string 4 may also be approximately two octaves apart. Because the plurality of strings 112 each have a different thickness and have been rearranged, the nut 126 of the electric guitar is modified, recut, or replaced to receive the new order of the strings 112. For example, in one embodiment, string 6 may be the thickest string, and string 1 may be the thinnest string. Thus, when the thicker string 6 occupies the space made for thinner string 1, the groove of the nut 126 that originally received thinner string 1 must be made wider to receive the thicker string 6, and when the thinner string 1 occupies the space made for the thicker string 6, the groove of the nut 126 that originally received thicker string 6 must be made narrower to receive the thinner string 1. Similarly, at the other end of the plurality of strings 112 where the plurality of strings 112 are coupled to the bridge 110, the bridge 110 must be modified so that the space previously occupied by the thinner string 1 can receive the thicker string 6, and the space previously occupied by the thicker string 6 can receive the thinner string 1. The number of strings 112 is not meant to limit the invention. In other constructions, there may be more or less than the six strings 112 shown in the figures.

Figure 5:
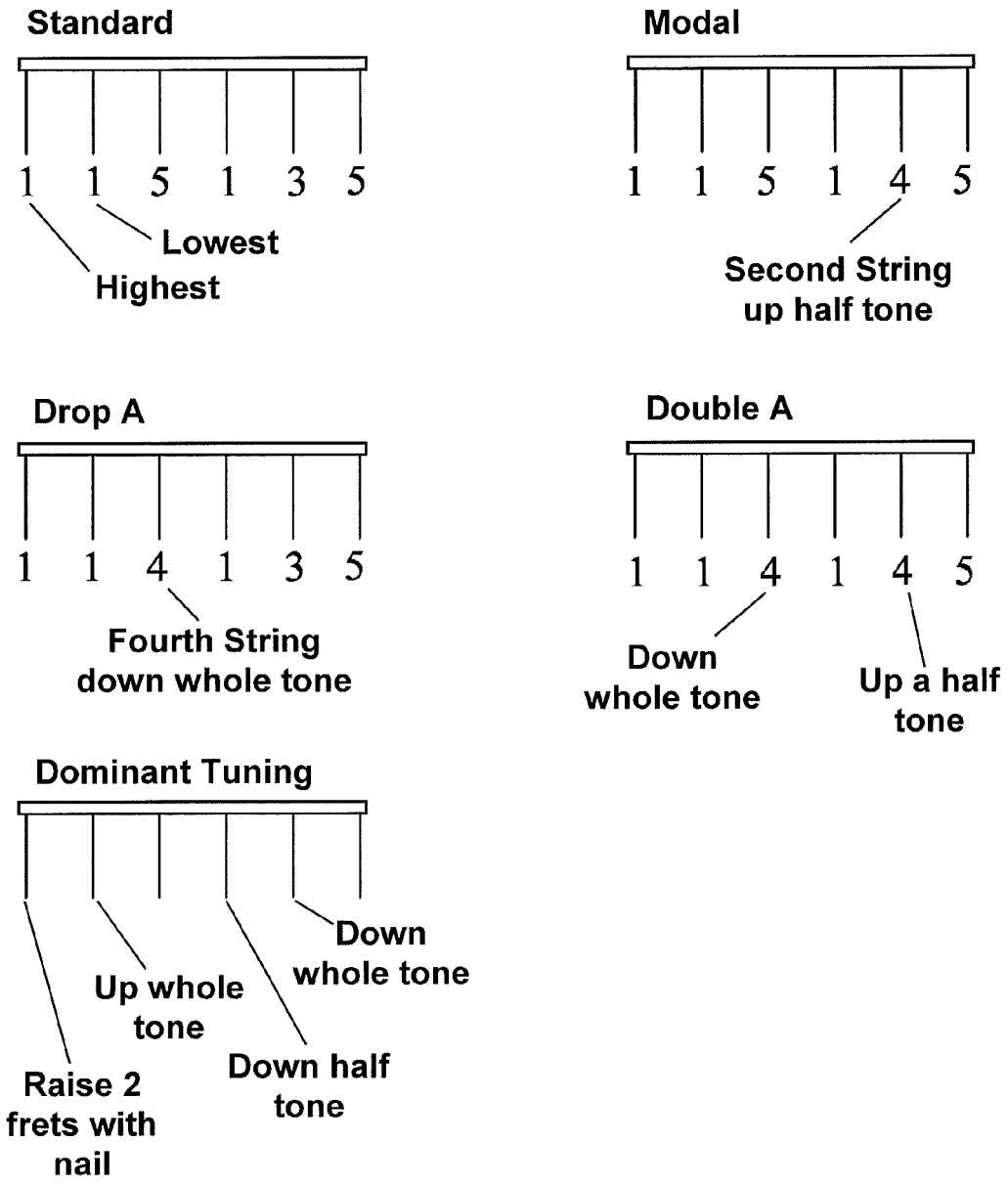
FIG. 5 is a schematic showing exemplary tunings of the stringed instrument shown in the various figures of the specification.

Once the plurality of strings 112 are rearranged, the tuners 108 are adjusted so that each string 112 has its appropriate tension. In one embodiment, one of the plurality of strings 112 is tuned, and the other strings 112 are tuned relative to the tuned string 112. Referring to FIGS. 4 and 5, with the strings 112 rearranged into 1-6-5-4-3-2, the scale tones relationship and/or tuning can be 1 (high root)-1 (low root)-5-1-3-5. The 1 (low root) is approximately at least two octaves lower than the 1 (high root). In FIG. 5, the scale tones relationship and/or tuning that is 1 (high root)-1 (low root)-5-1-3-5 is referred to as "Standard." "Modal" tuning can be a scale tones relationship and/or tuning of 1-1-5-1-4-5, where 4 is generally a half tone higher. "Drop A" tuning can be a scale tones relationship and/or tuning of 1-1-4-1-3-5, where 4 is generally a whole tone lower. "Double A" tuning can be a scale tones relationship and/or tuning of 1-1-4-1-4-5, where the first 4 is generally a half tone lower and the second 4, next to the 5, is about a half tone higher. "Dominant tuning" can be a scale tones relationship and/or tuning where an outermost string 112 is approximately two frets higher, the next string 112 is about a whole tone higher, and another two strings 112 are approximately a half tone lower and approximately a whole tone lower. The scale tones relationships and/or tunings shown in FIGS. 4 and 5 are not meant to limit the invention. Other scale tones relationships and/or tunings may be used with the stringed instrument 100. For example, open tuning may be used, wherein one or more of the plurality of strings 112 are tuned to a chord. Alternatively, one string 112 can be tuned, and the remaining strings 112 can be tuned relative to the one string 112 that was tuned. Also, the plurality of strings 112 can be tuned in quarters, or the plurality of strings 112 can be tuned in thirds so that the sound of each string 112 is closer to each other that strings 112 tuned in fourths.

Figure 6:
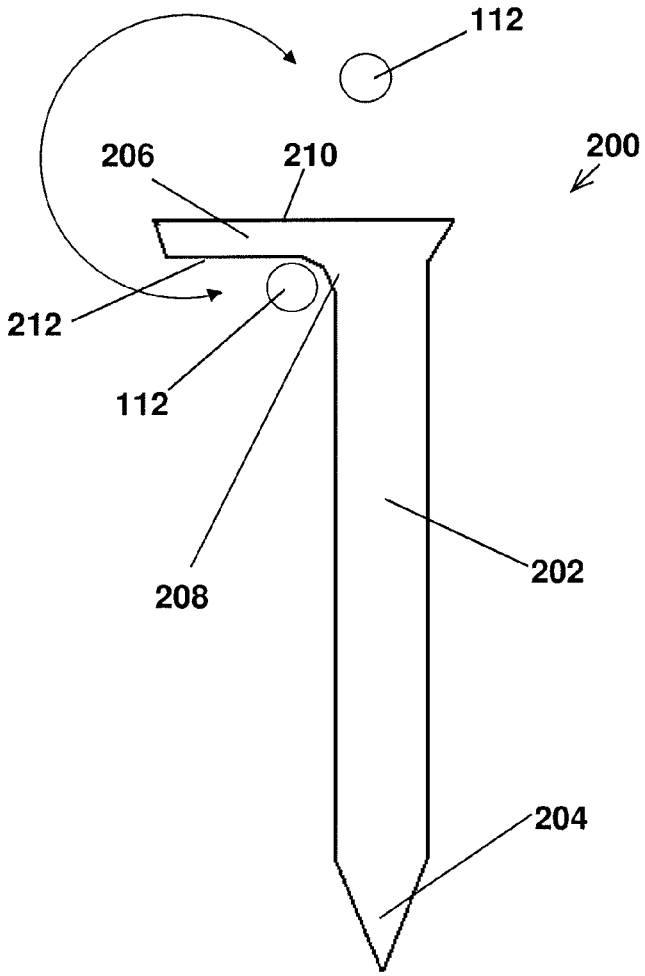
FIG. 6 is a side elevational view of an embodiment of a spike of the stringed instrument shown in the various figures of the specification.

Referring to FIGS. 1, 2, 3, and 6, the stringed instrument 100 further includes one or more spikes 200. The one or more spikes 200 are adapted to retain at least one of the plurality of strings 112. Turning to FIG. 6, the spike 200 can include an elongated body 202 with a piercing end 204 for piercing into the stringed instrument 100 and a hooking end 206 for receiving and retaining one of the plurality of strings 112. In FIG. 6, the elongated body 202 and the hooking end 202 form a corner 208. The corner 208 may have a curvature to it, as depicted in FIG. 6, or in a preferred construction, may constitute a right angle. Furthermore, the hooking end 206 may include a flat surface 210 so as to facilitate hammering the spike 200 into the stringed instrument 100. In the embodiment depicted in FIGS. 1, 2, and 3, the spike 200 may be formed from a tiny HO scale railroad spike. HO scale or gauge is approximately 1/87.5 of life size, and thus, a HO scale railroad spike is approximately five-sixteenths (5/16) of an inch or approximately seven (7) millimeters in length. One example of the spike 200 has an elongated body 202 that is about 5/16 of an inch long with a hooking end 206 extending about 1/16 of an inch in a direction transverse to the elongated body 202. The elongated body 202 and the hooking end 206 of the spike 200 formed from a HO scale railroad spike may be filed, grinded, or otherwise adjusted near where the elongated body 202 and the hooking end 206 meet so that the spike 200 can better retain a string 112. For example, a groove, a slit, a cavity, or some other feature adapted to enhance the retention of a string 112 can be formed in the corner 208 where the elongated body 202 meets the hooking end 206 and where the string 112 is retained. In the depicted embodiment, a portion 212 of the HO scale railroad spike corresponding to the hooking end 206 was ground to be flatter and thus better able to receive and retain at least one of the plurality of strings 112. Furthermore, a tension of one of the plurality of strings 112 may aid the spike 200 in retaining the one of the plurality of strings 112. Also, a spike 200 formed from a HO scale railroad spike can also minimize changes to the aesthetic appeal of the rest of the stringed instrument 100. Using a spike 200 that has the same or similar color as the fretboard 122 may further this purpose. However, in other embodiments, similarly shaped and sized components can be used as at least one or more of the spikes 200. Also, the spike 200 may further include one or more knurls, protrusions, hooks, contours, friction surfaces, some other mechanical feature that aids in or performs the function of retaining a string 112, or some combination of the aforementioned. In still other constructions, any device adapted to retain at least one of the strings 112 can be used as at least one of the spikes 200.

Referring to FIG. 1, the spike 200 is inserted into the stringed instrument 100 such that the hooking end 206 extends generally perpendicularly to the longitudinal length of the neck 104 and towards a center of the neck 104. Alternatively, as shown in FIG. 2, the spike 200 can be inserted so that the hooking end 206 extends generally perpendicularly to the longitudinal length of the neck 104 and away from the center of the neck 104. The spikes 200 are preferably placed where the player can slip the string 112 under the head of one of the spikes 200, where it works like an automatic or auxiliary finger, holding the string 112 down against the fret 124. In the location(s) shown, for example, one can still fret the string 112 whether or not the spike 200 is in use.

Also, in other constructions, one or more of the spikes 200 can be formed integrally with the fretboard 122 or the neck 104. In such constructions, the spike 200 would include an elongated body 202 that protrudes from the stringed instrument 100, and at the protruding end of the elongated body 202, the spike 200 would include the hooking end 206. In yet other constructions, a spike 200 can be mechanically coupled to the stringed instrument 100, such as by bolting, interlocking mechanical parts, pressure fittings, some combination of the aforementioned, or some other mechanical coupling that allows an elongated body 202 to protrude from the stringed instrument 100 and a hooking end 206 to extend transversely to the elongated body 202.

Figure 7:
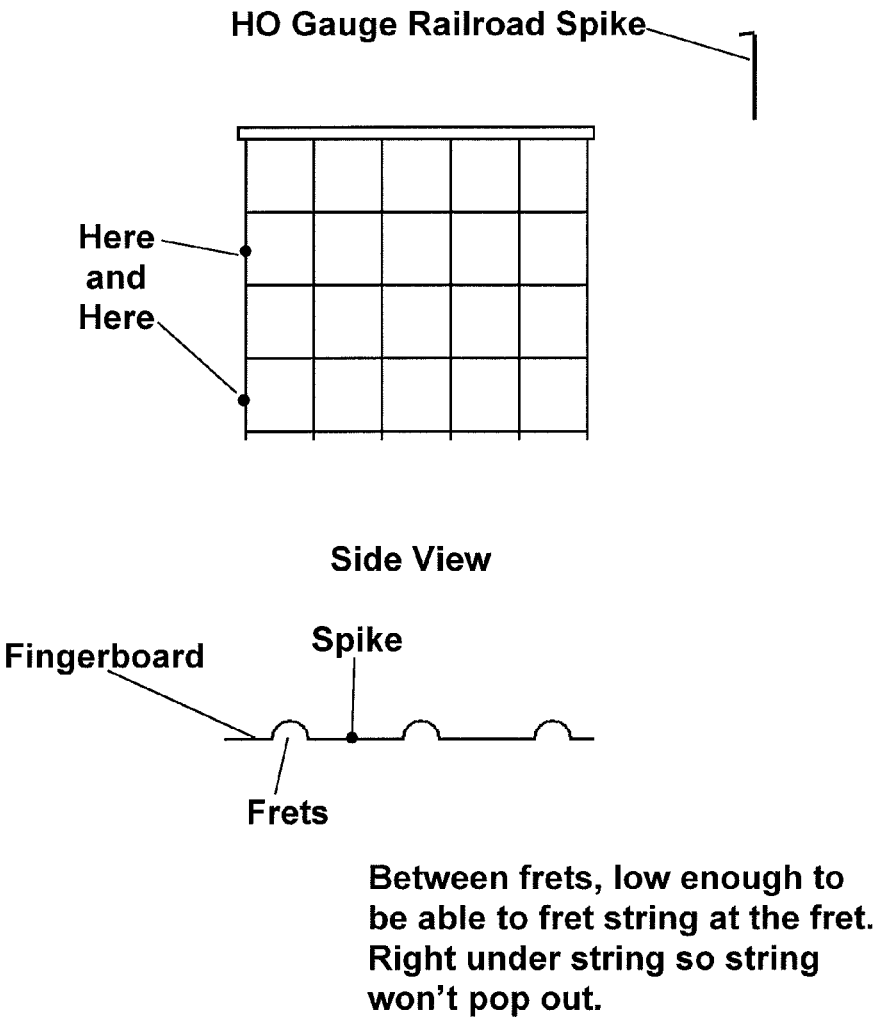
FIG. 7 is a schematic showing the arrangement of the spike of the stringed instrument shown in the various figures of the specification.
Figure 8:
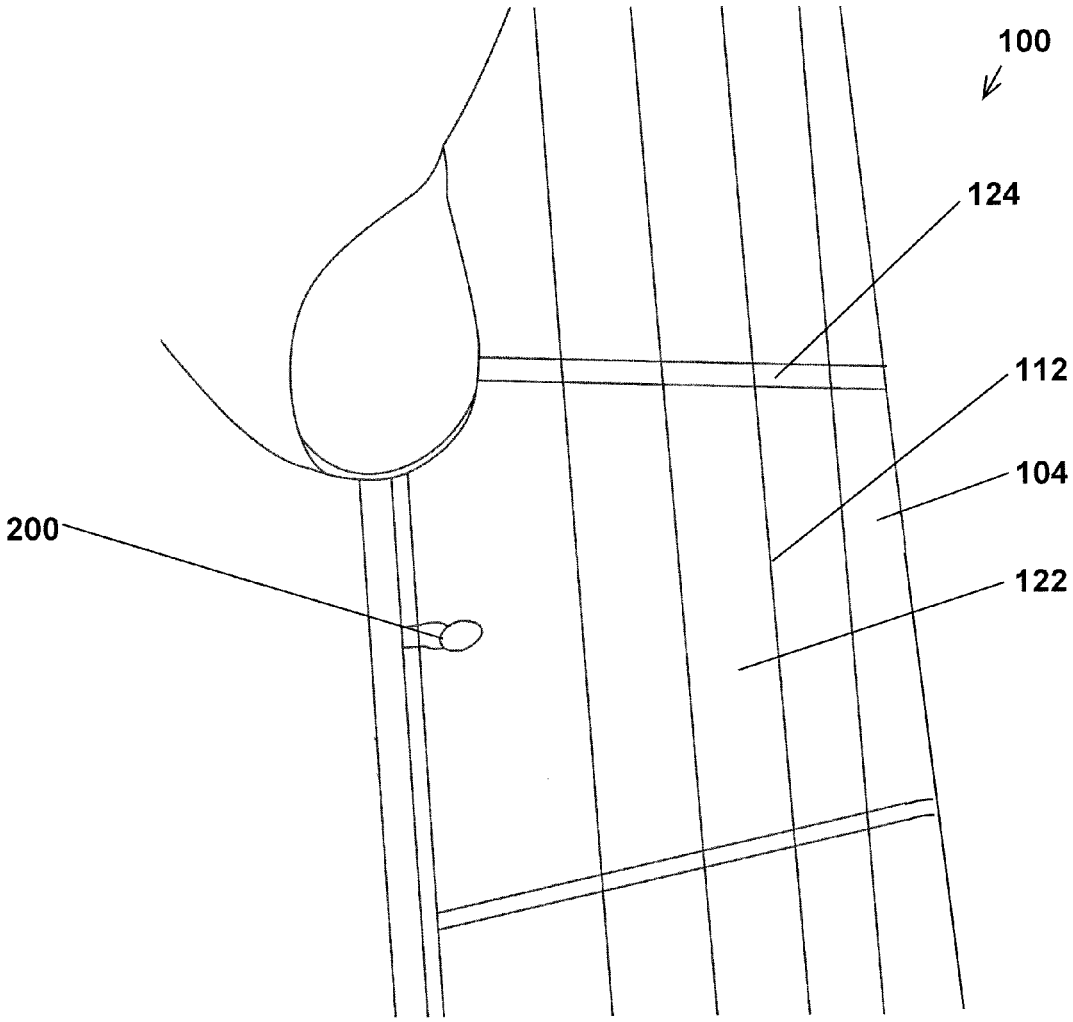
FIGS. 8-53 are partial perspective views of a stringed instrument in accordance with an embodiment of the invention, showing the steps for using the spike with one of the strings.
Figure 9:
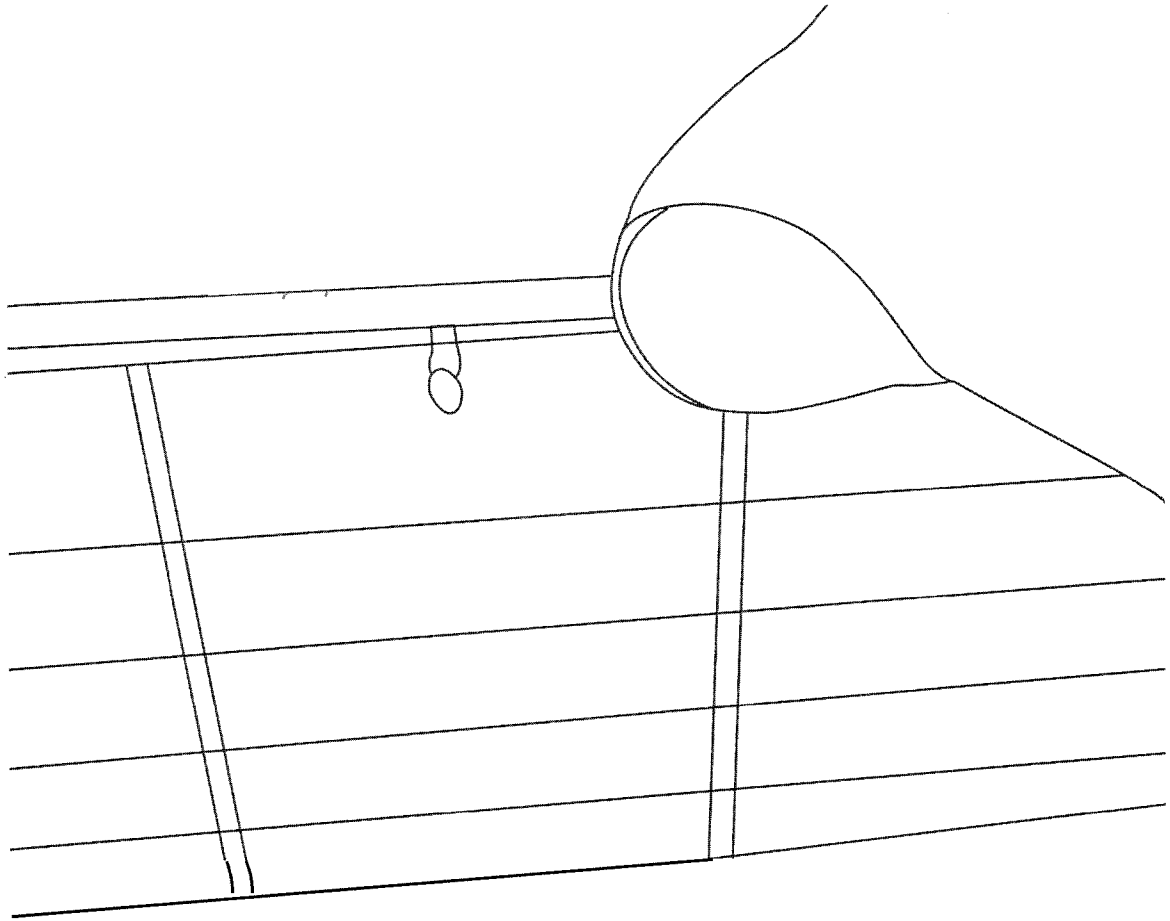
Figure 10:
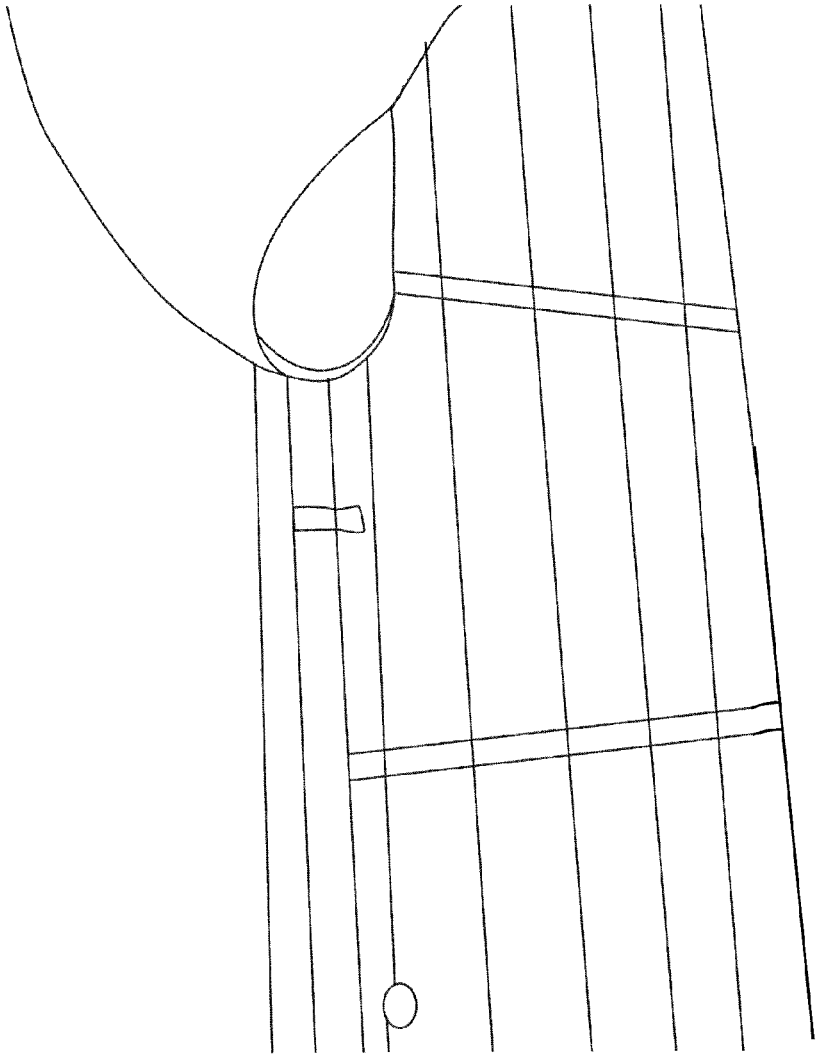
Figure 11:
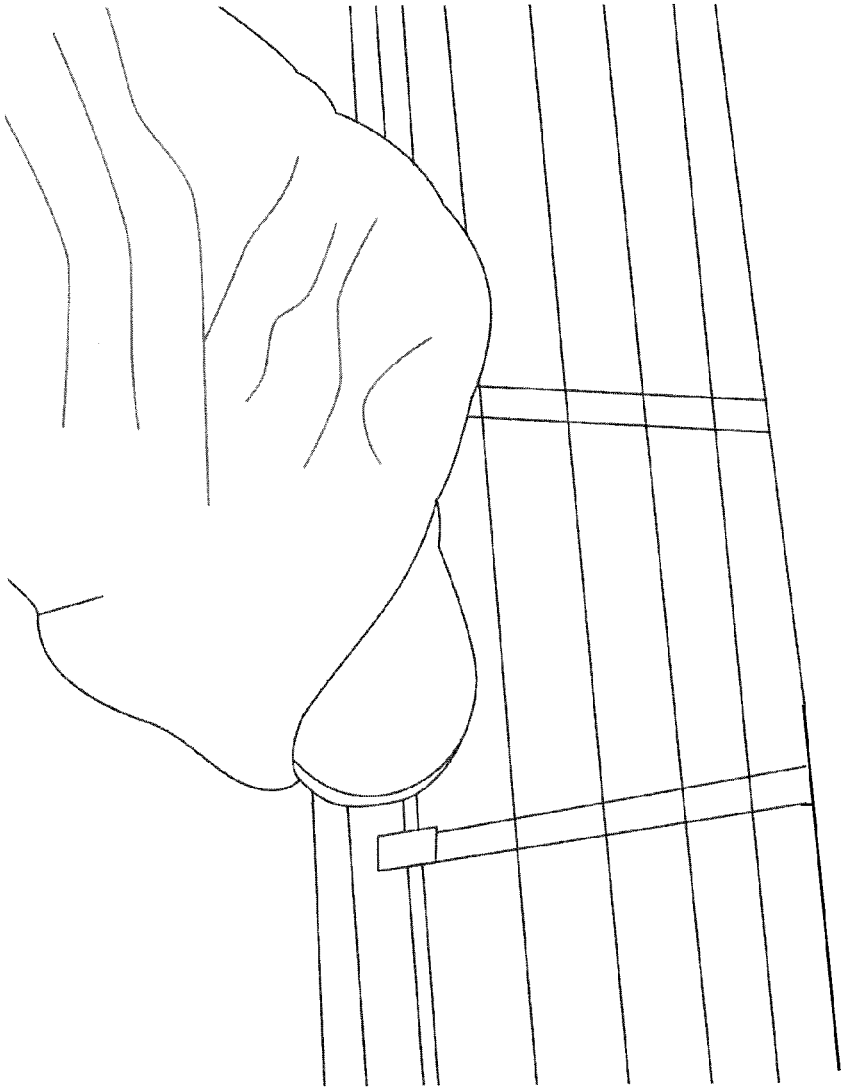
Figure 12:
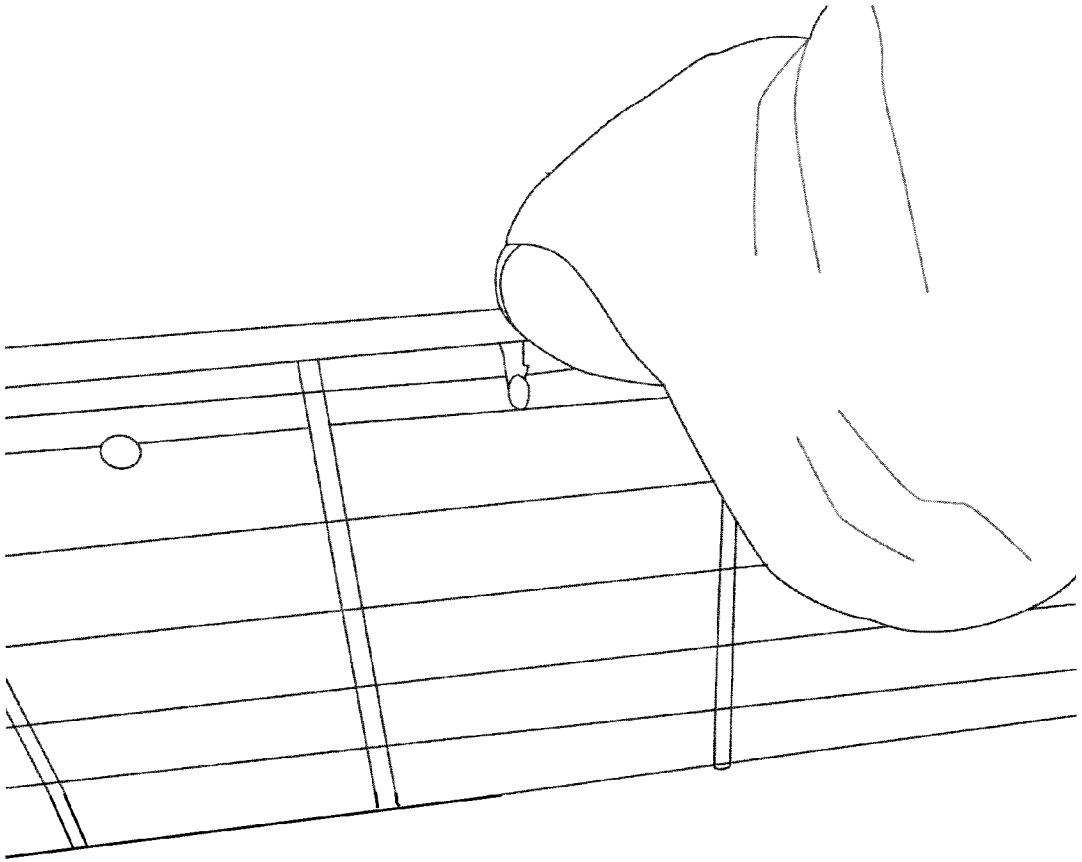
Figure 13:
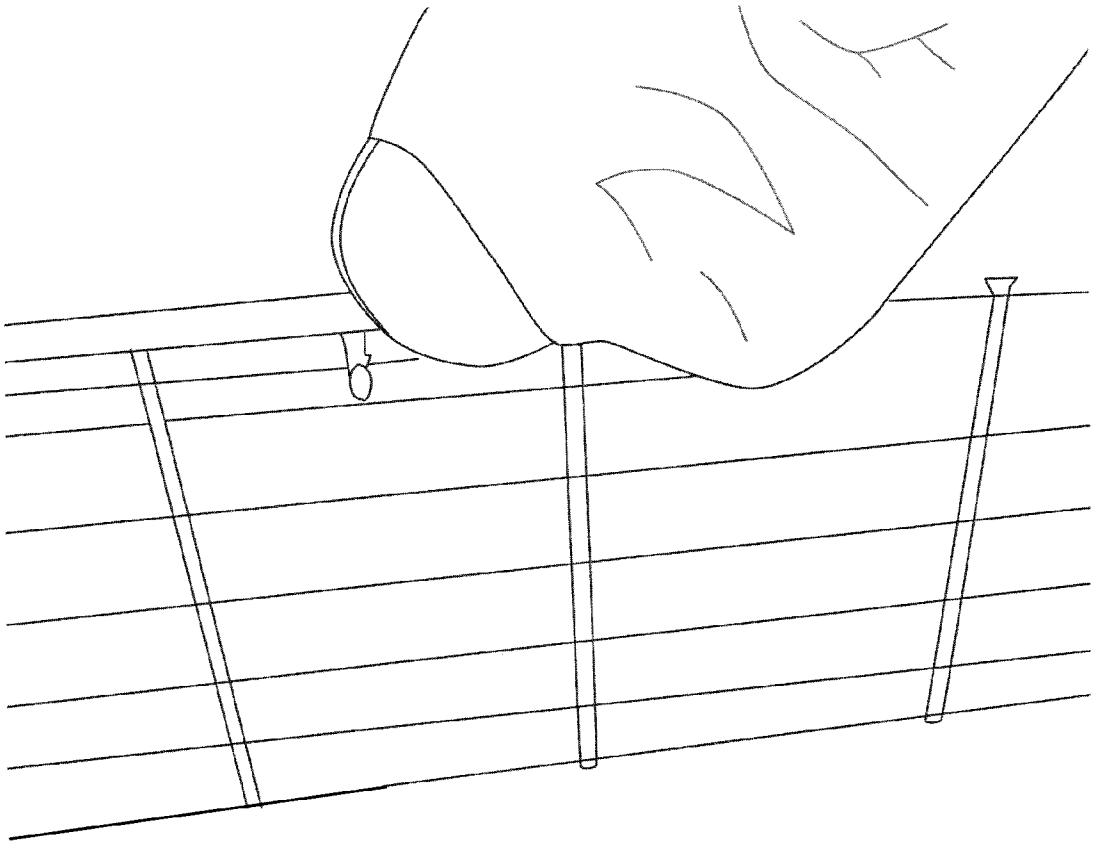
Figure 14:
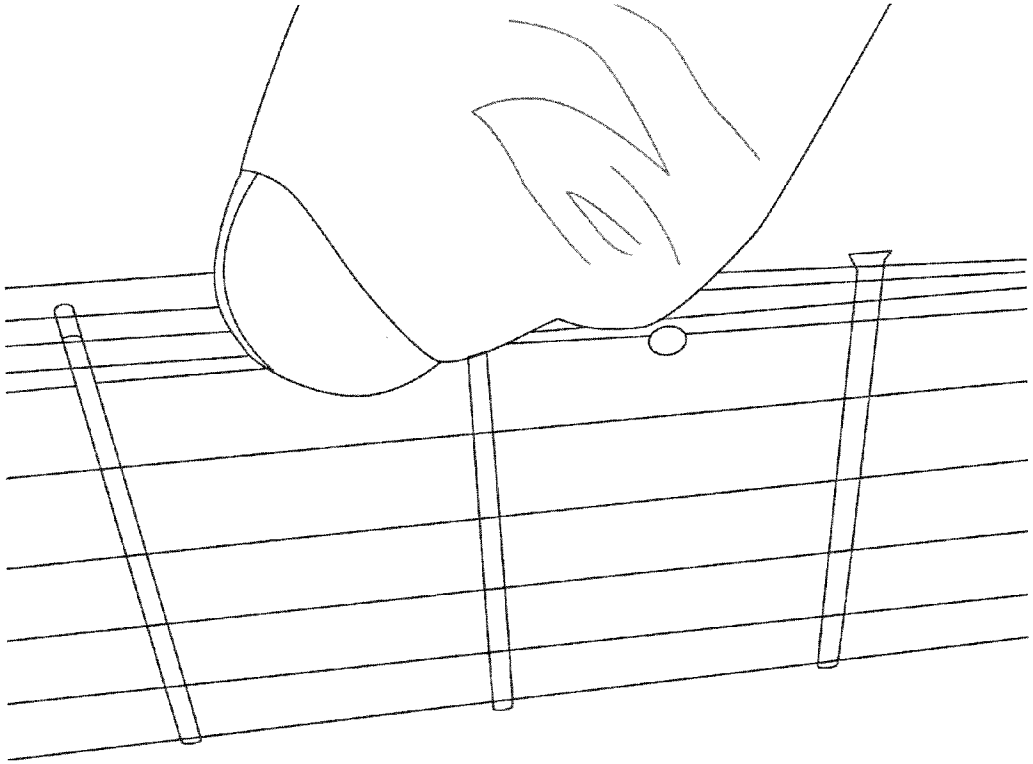
Figure 15:
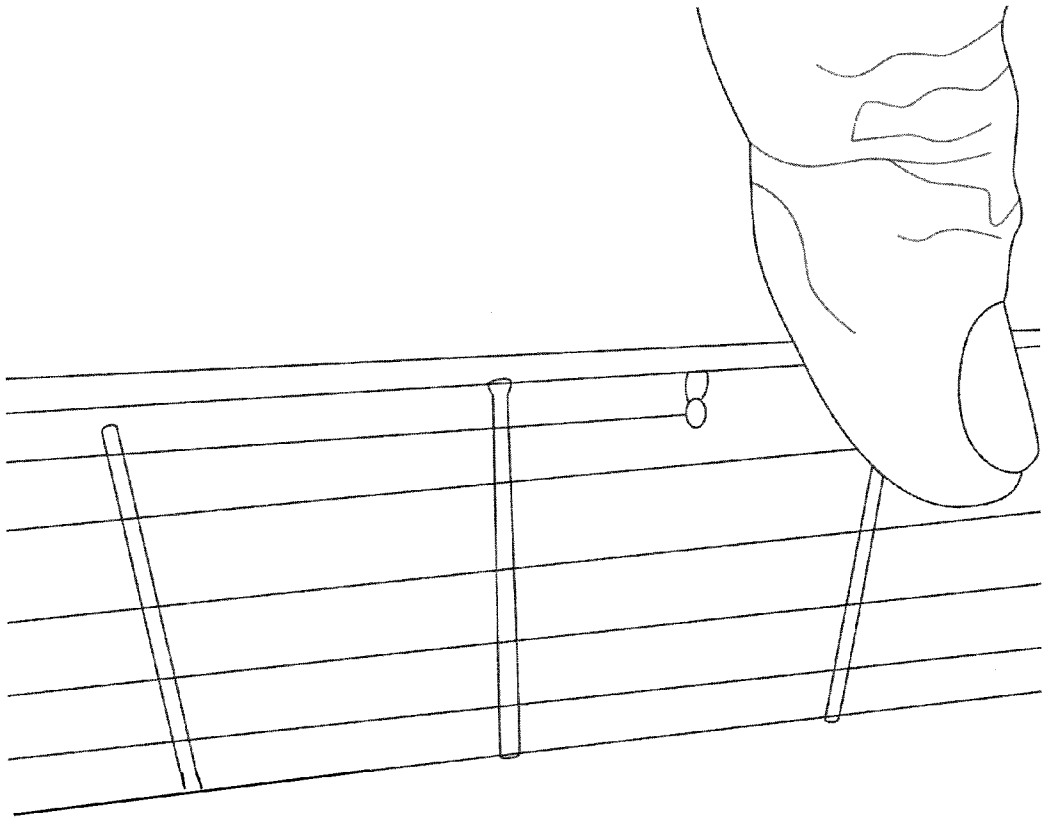
Figure 16:
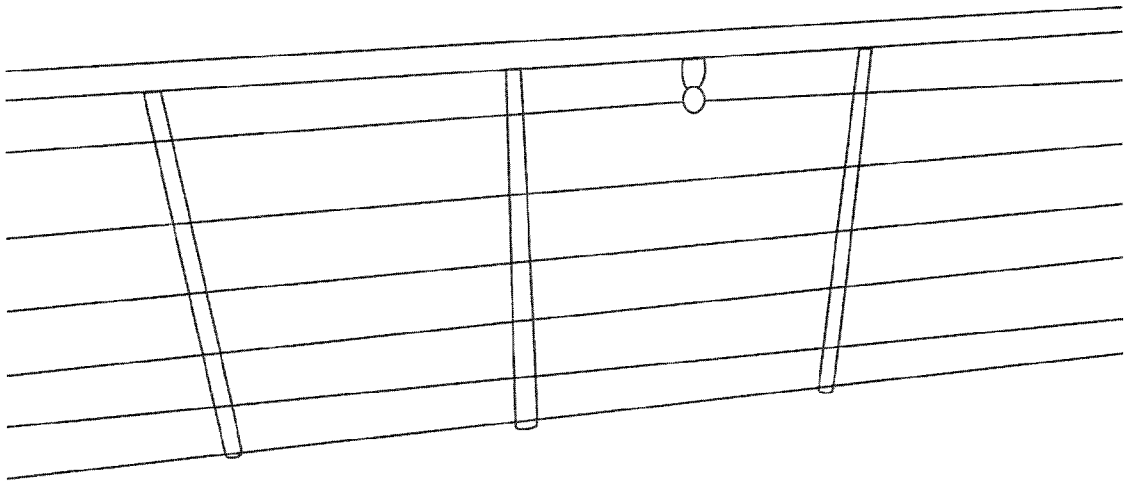
Figure 17:
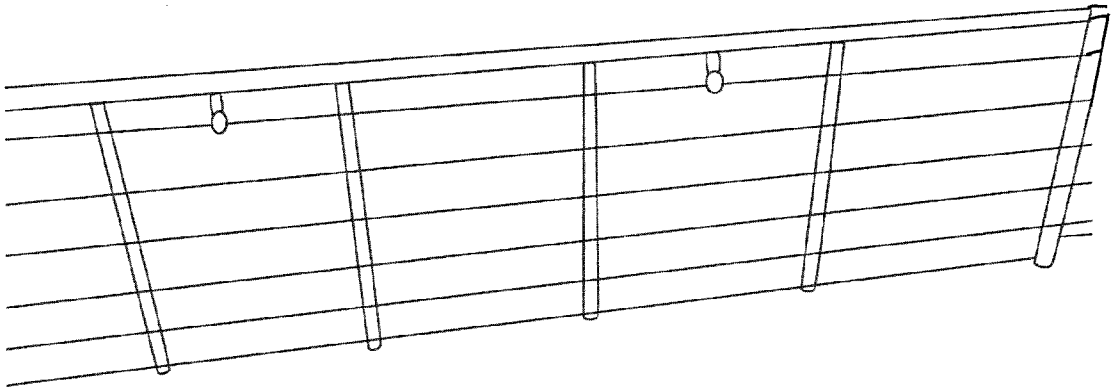
Figure 18:
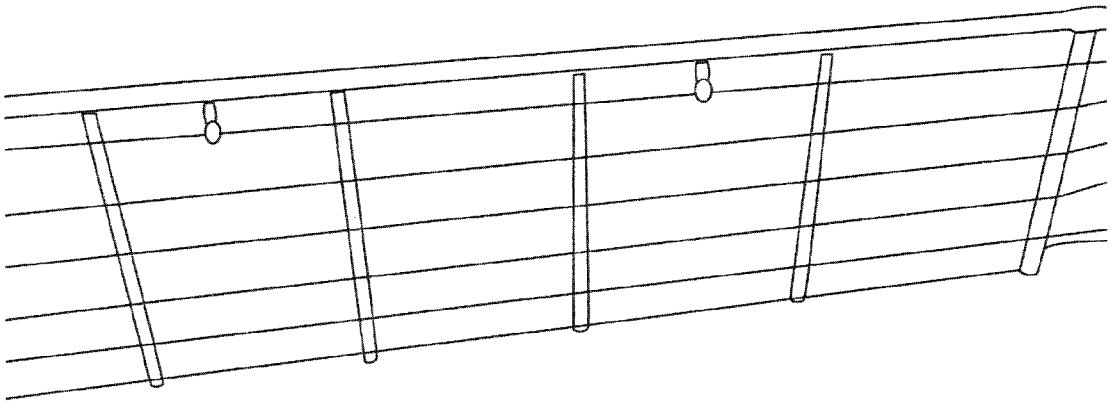
Figure 19:
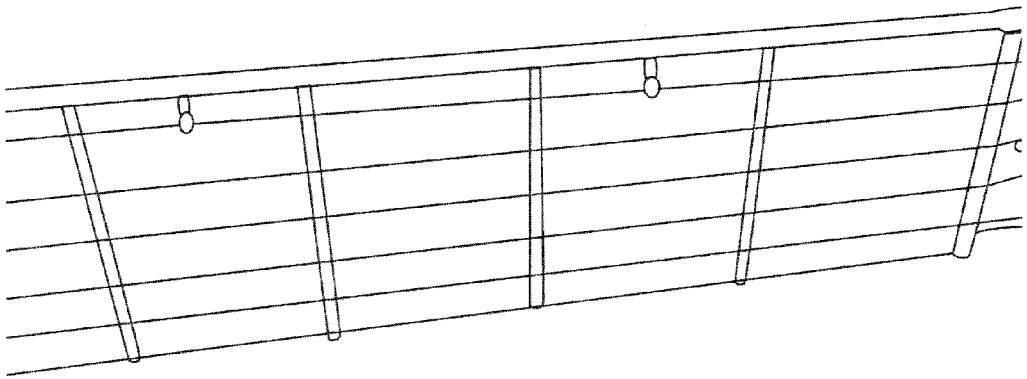
Figure 20:
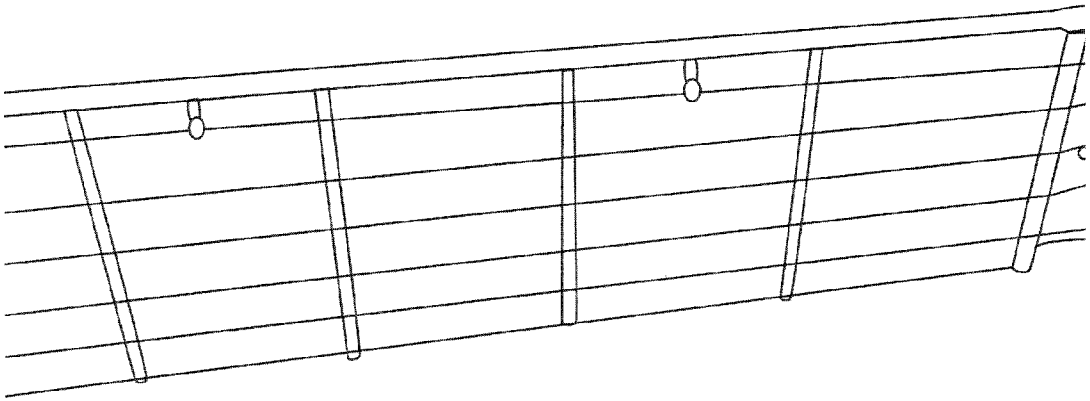
Figure 21:
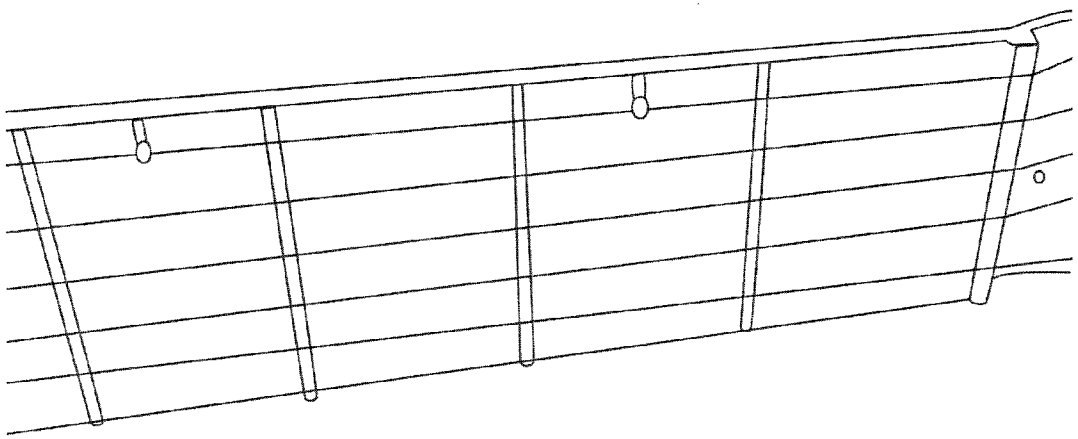
Figure 22:
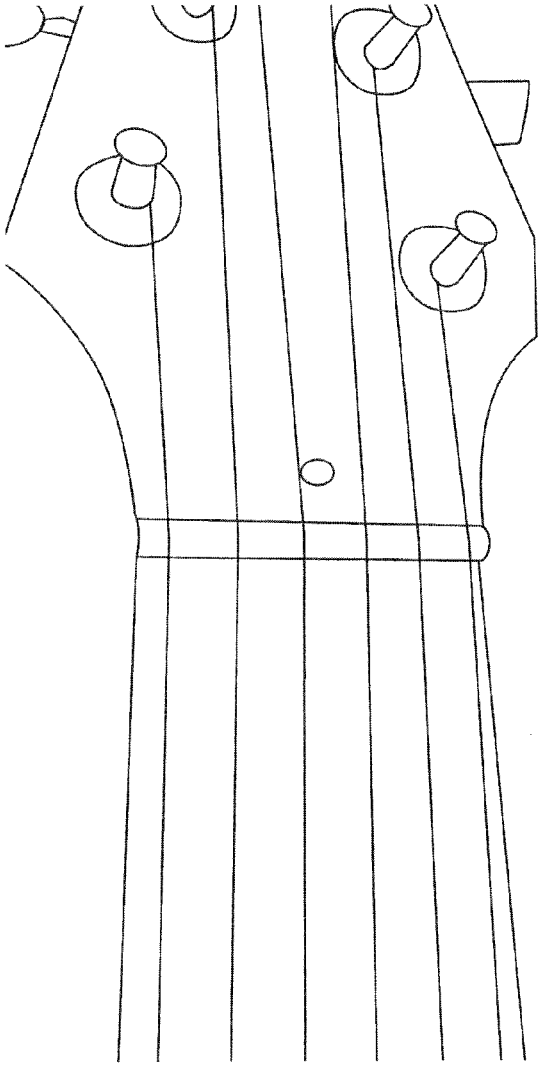
Figure 23:
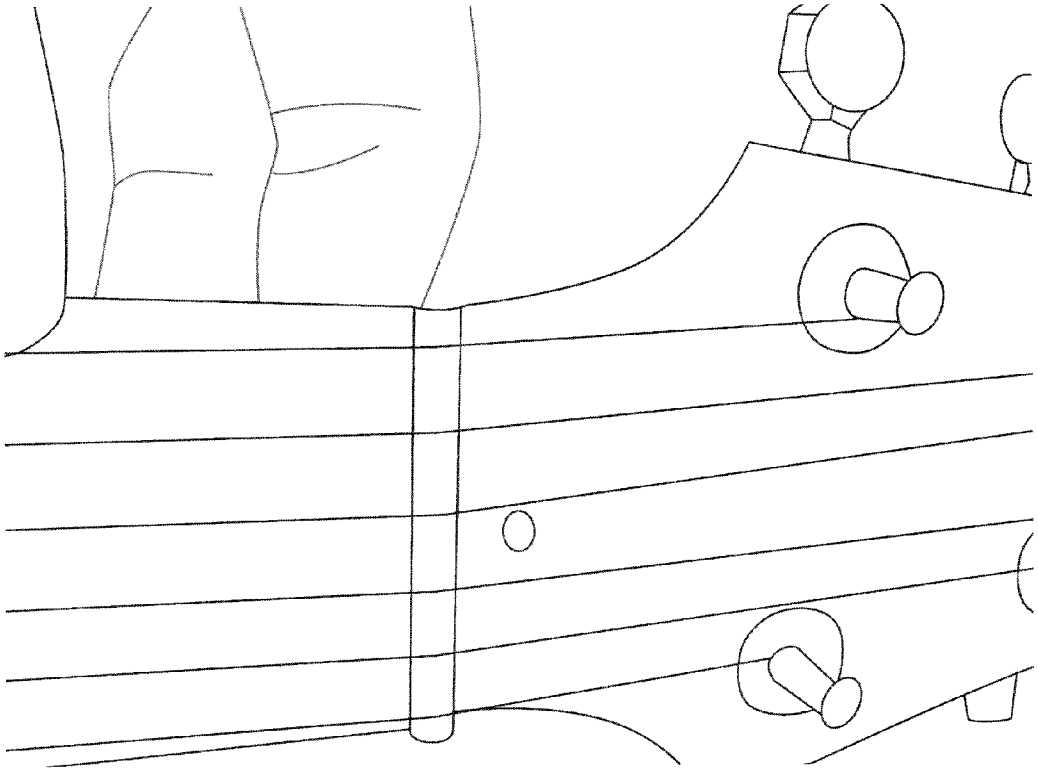
Figure 24:
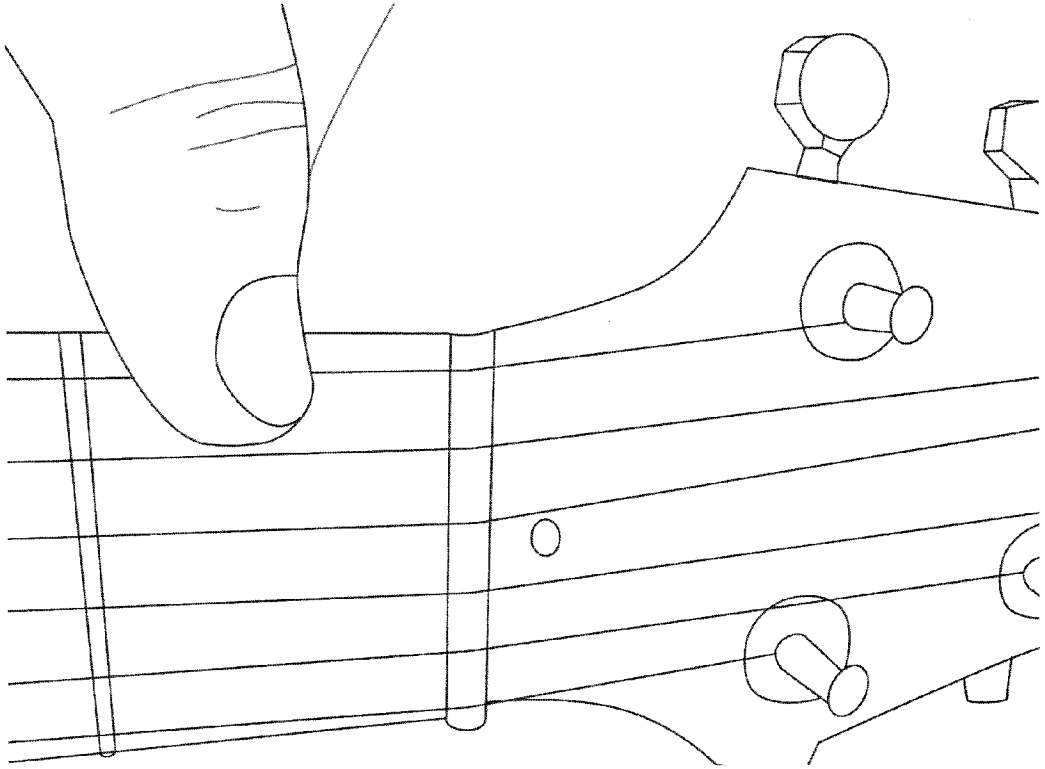
Figure 25:
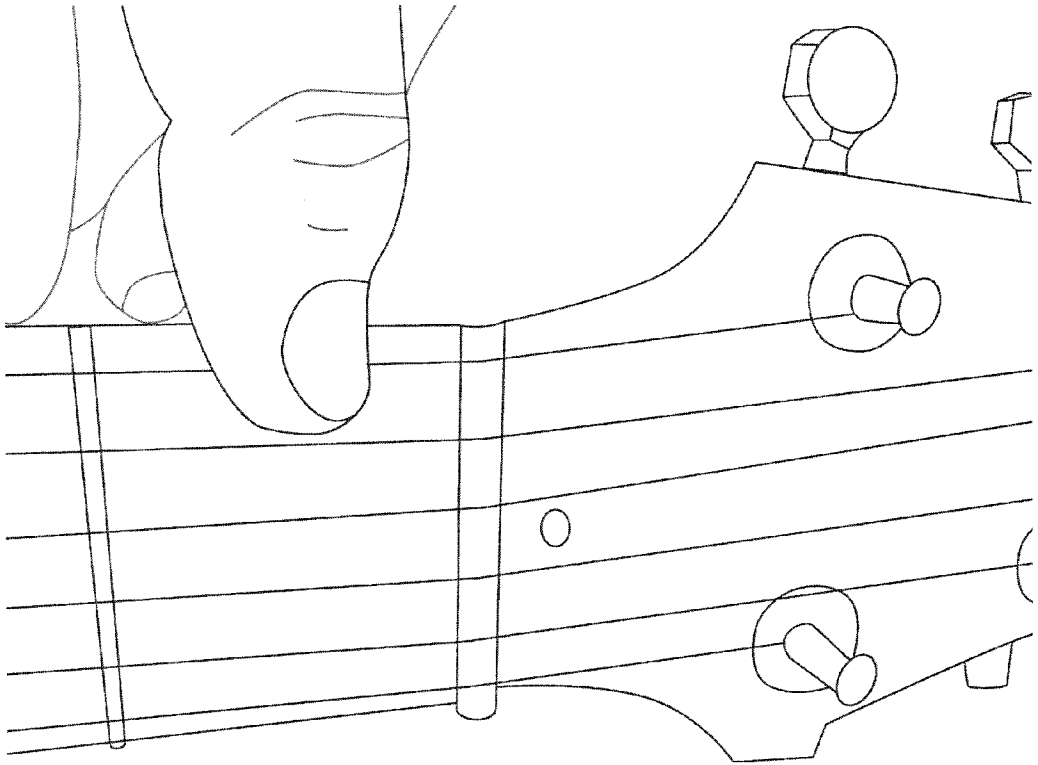
Figure 26:
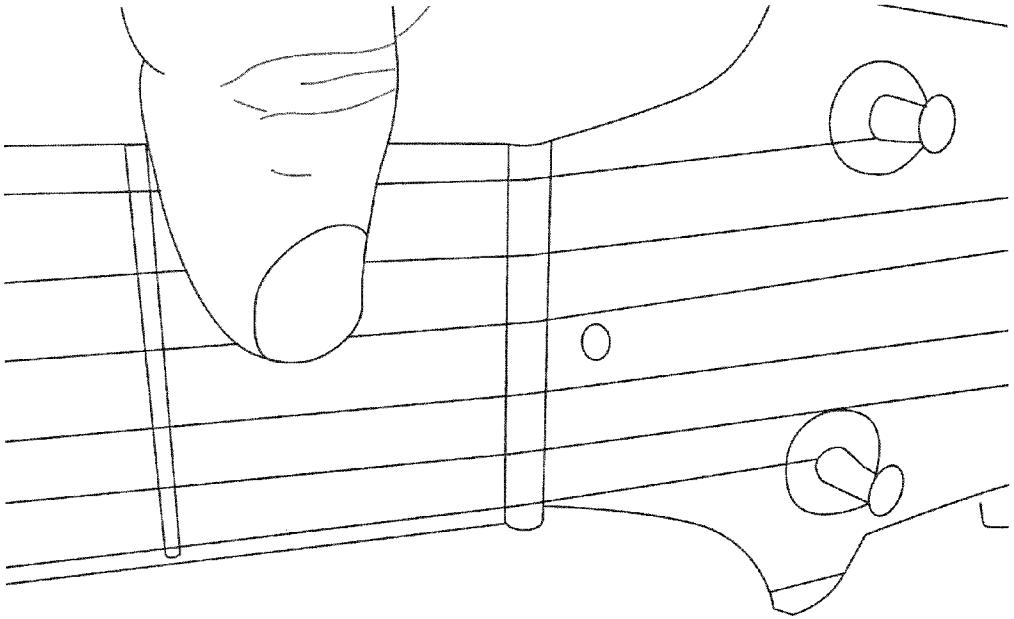
Figure 27:
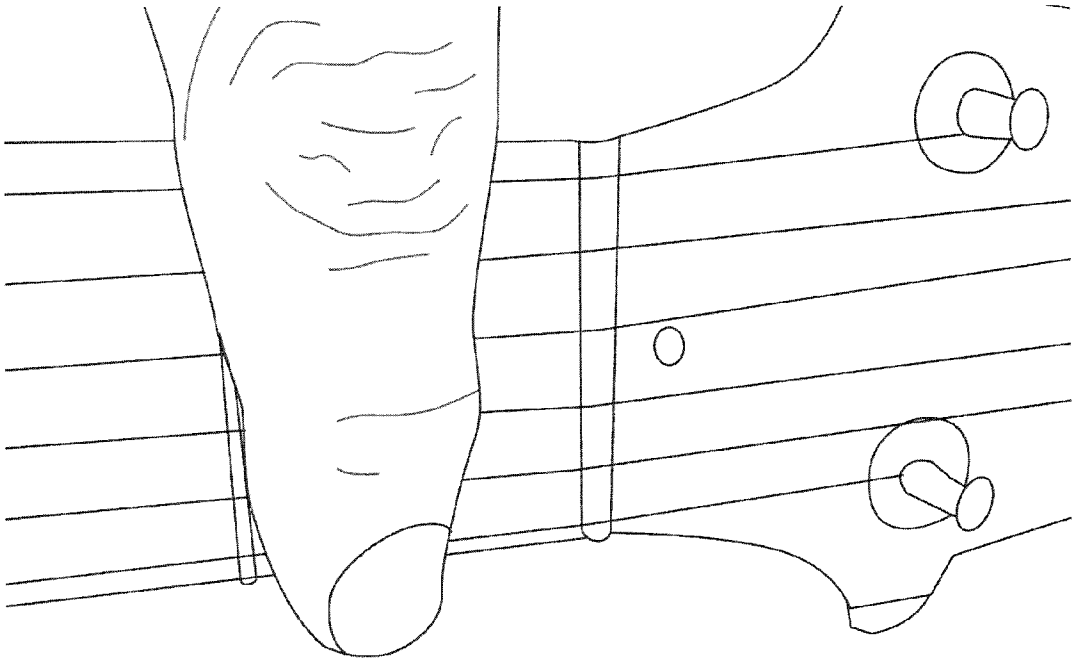
Figure 28:
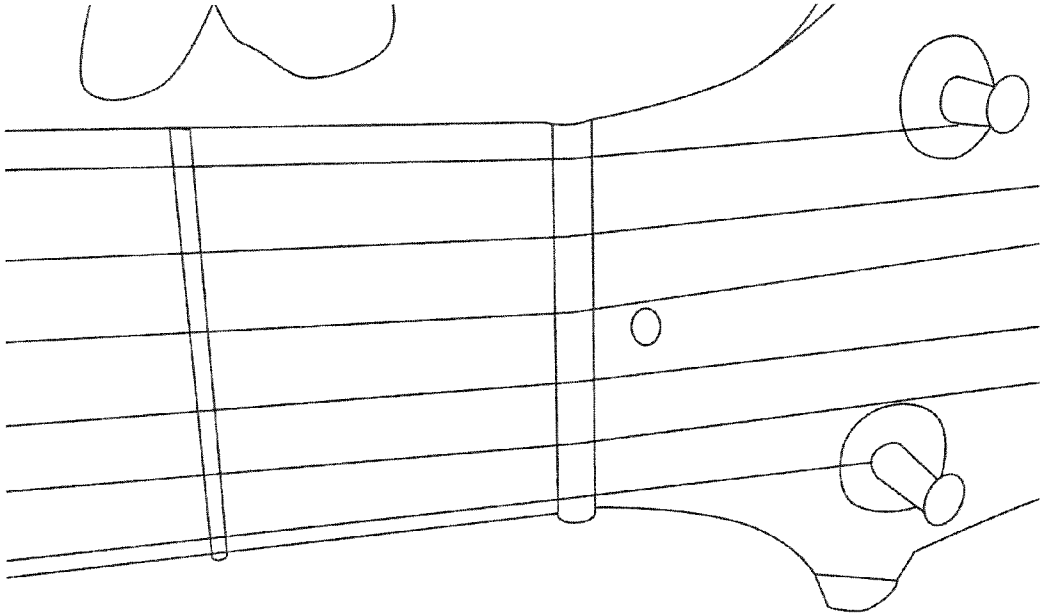
Figure 29:
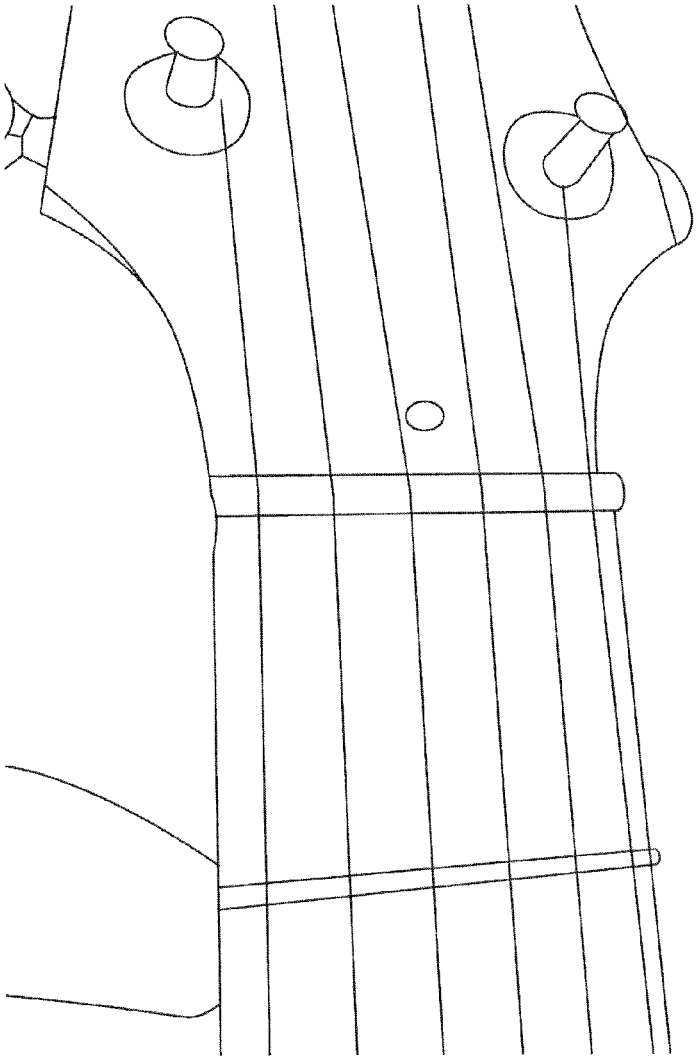
Figure 30:
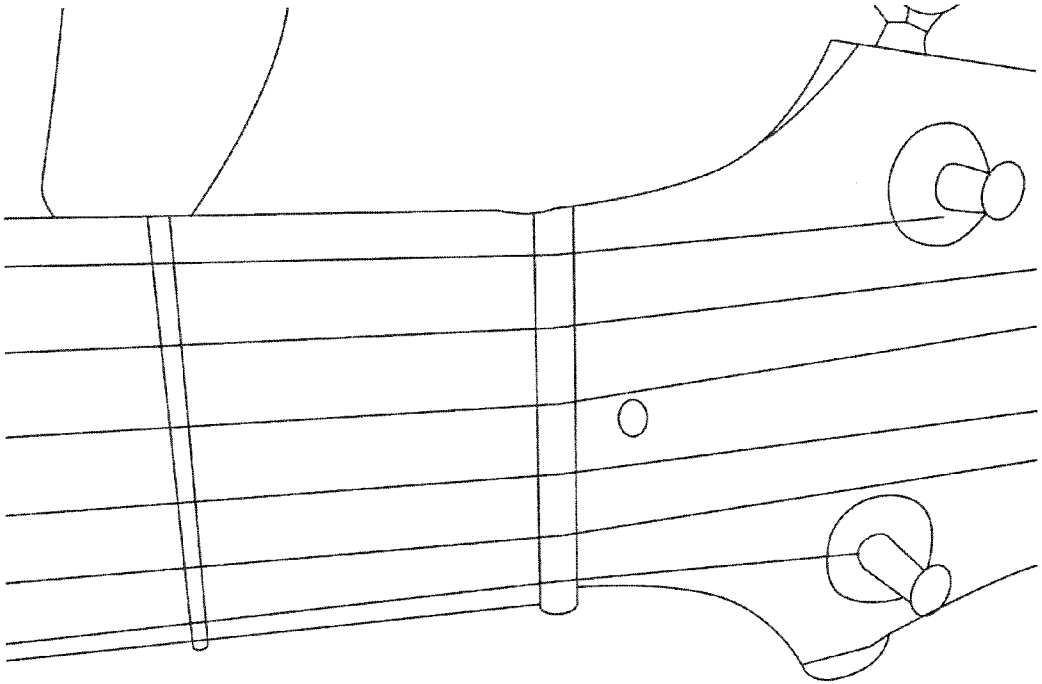
Figure 31:
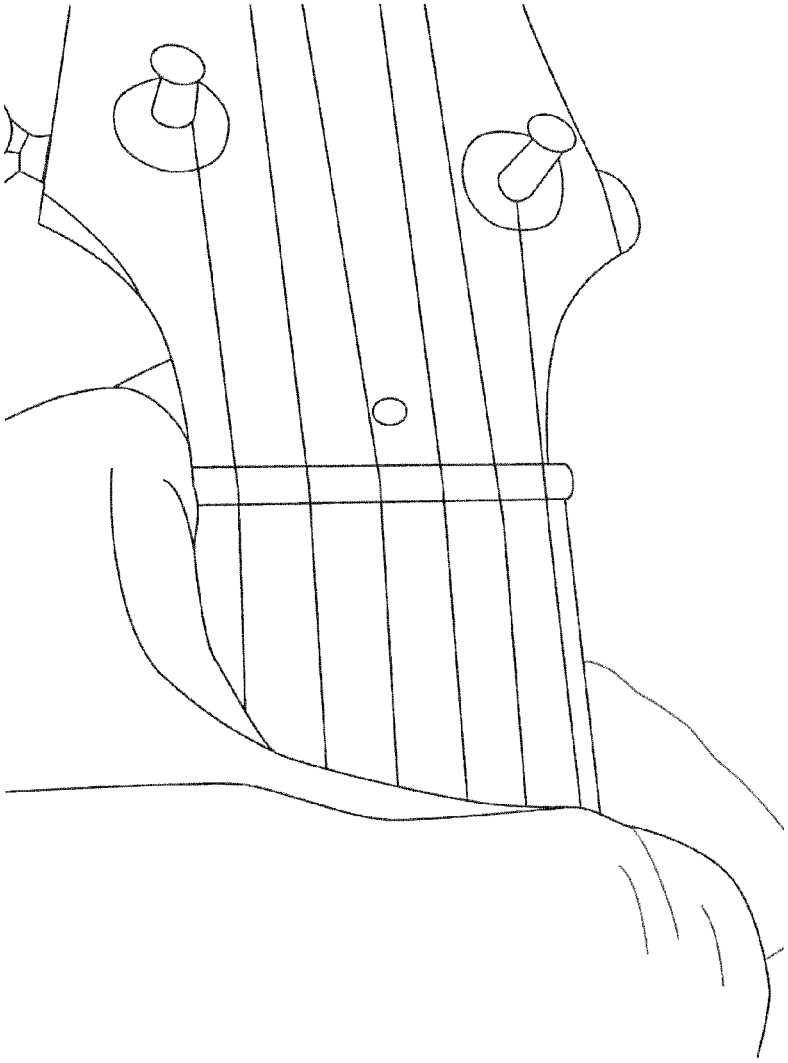
Figure 32:
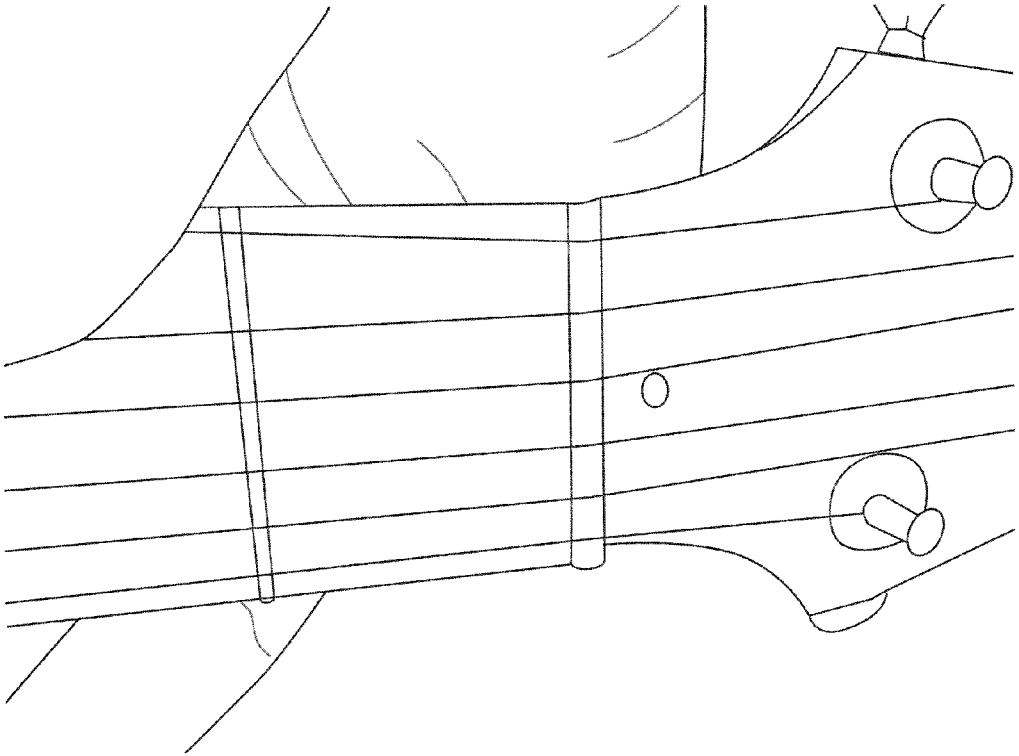
Figure 33:
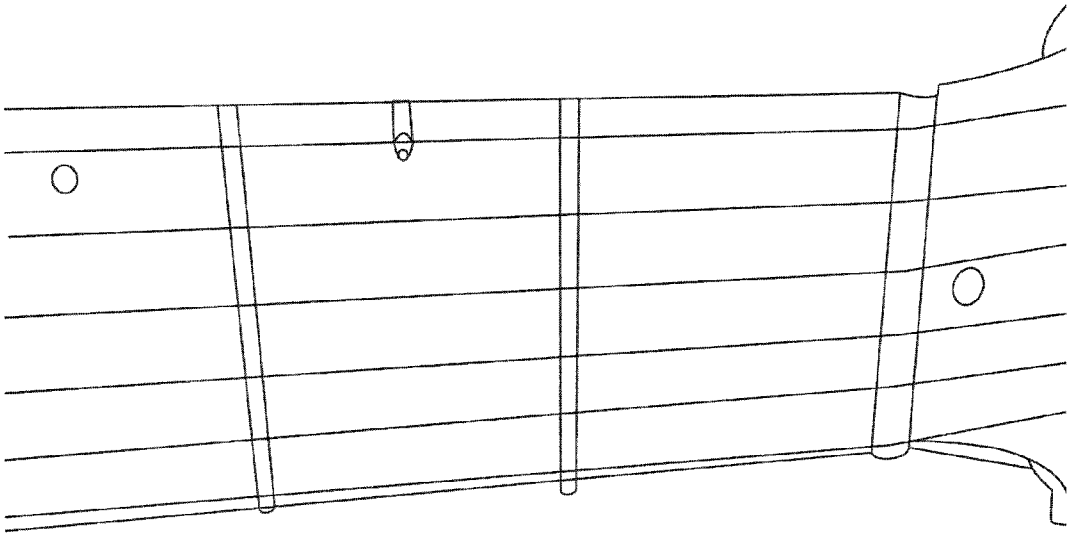
Figure 34:
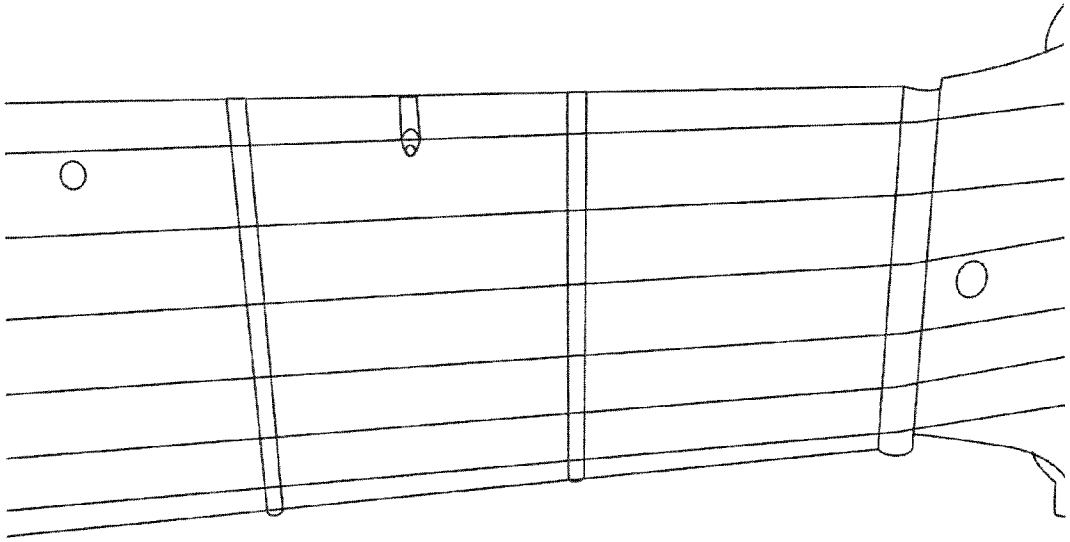
Figure 35:
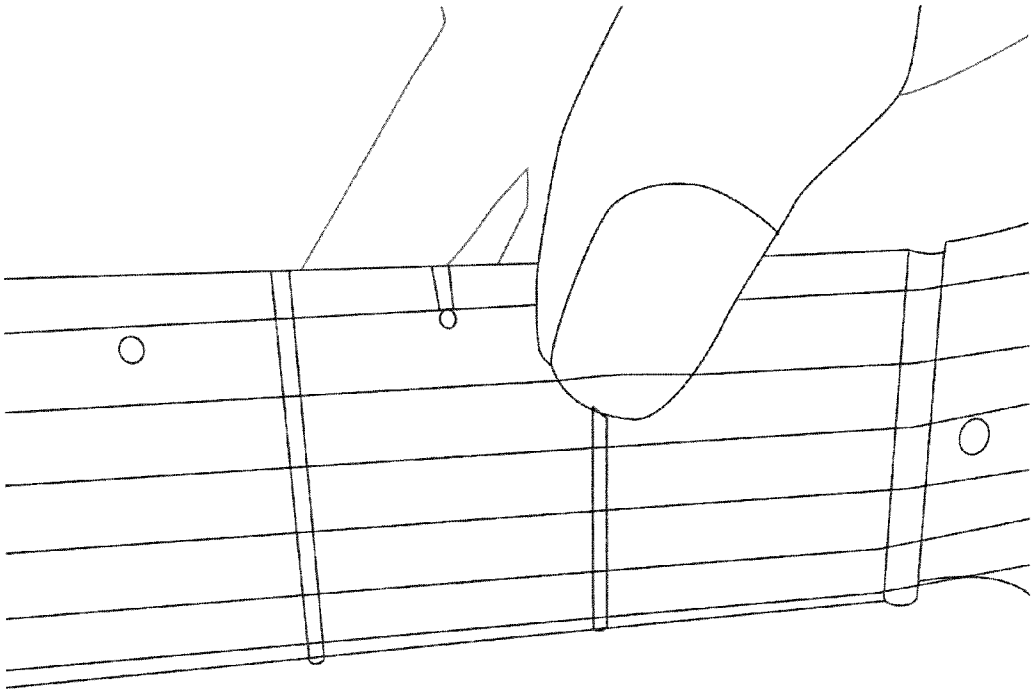
Figure 36:
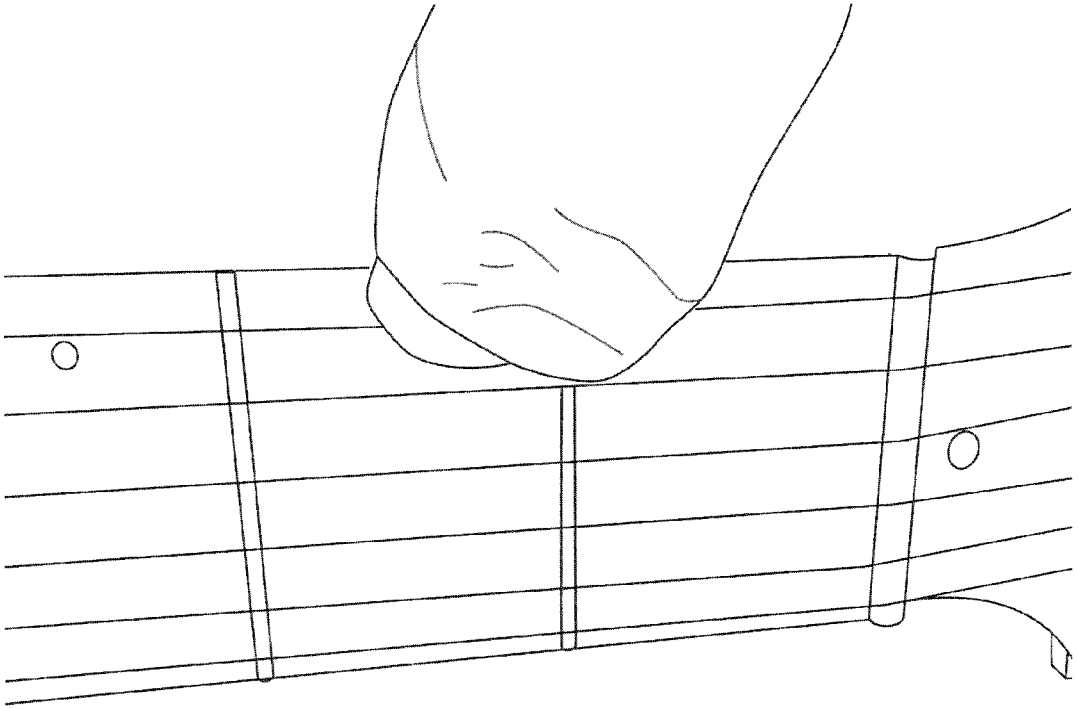
Figure 37:
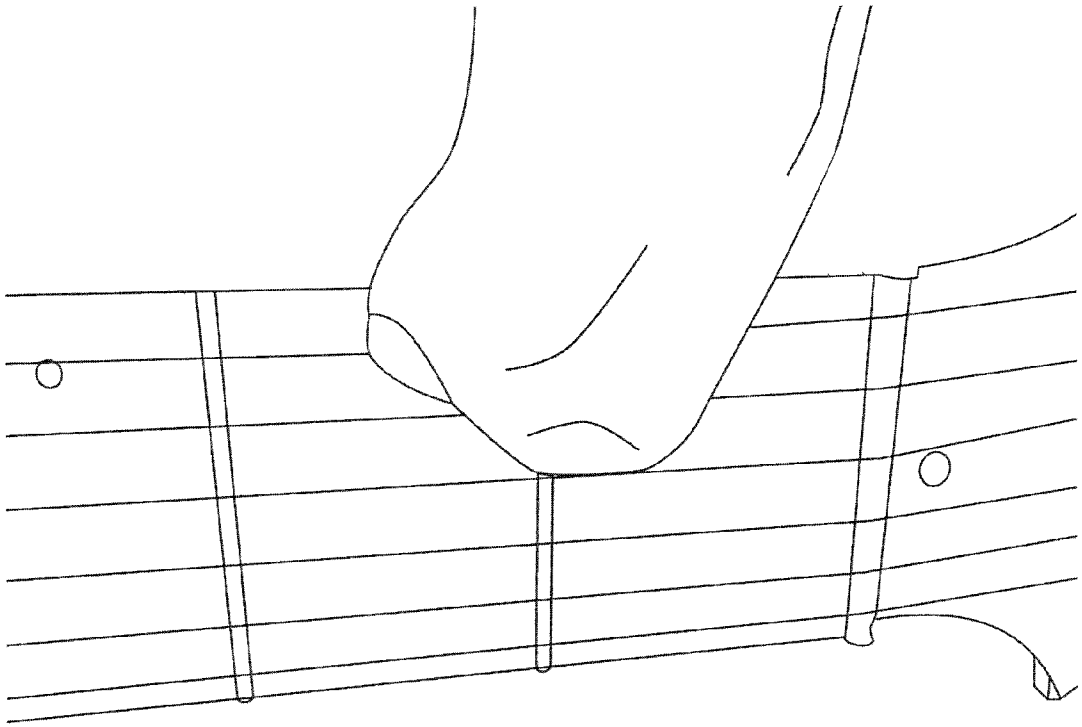
Figure 38:
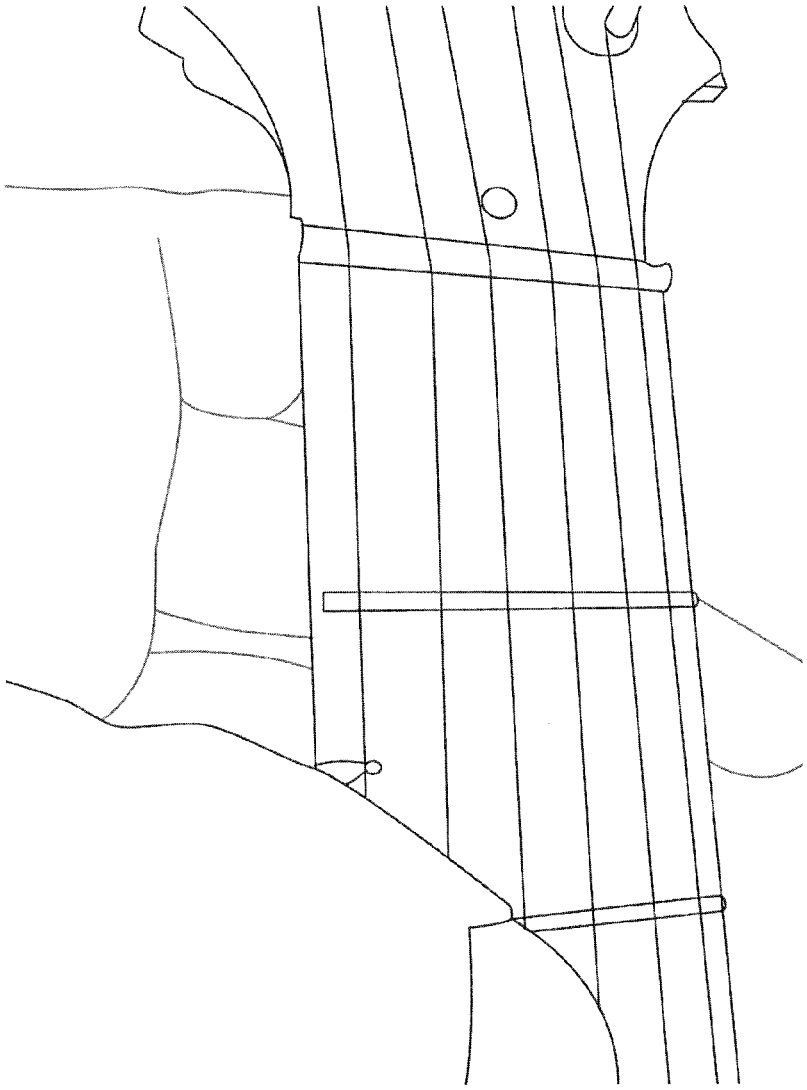
Figure 39:
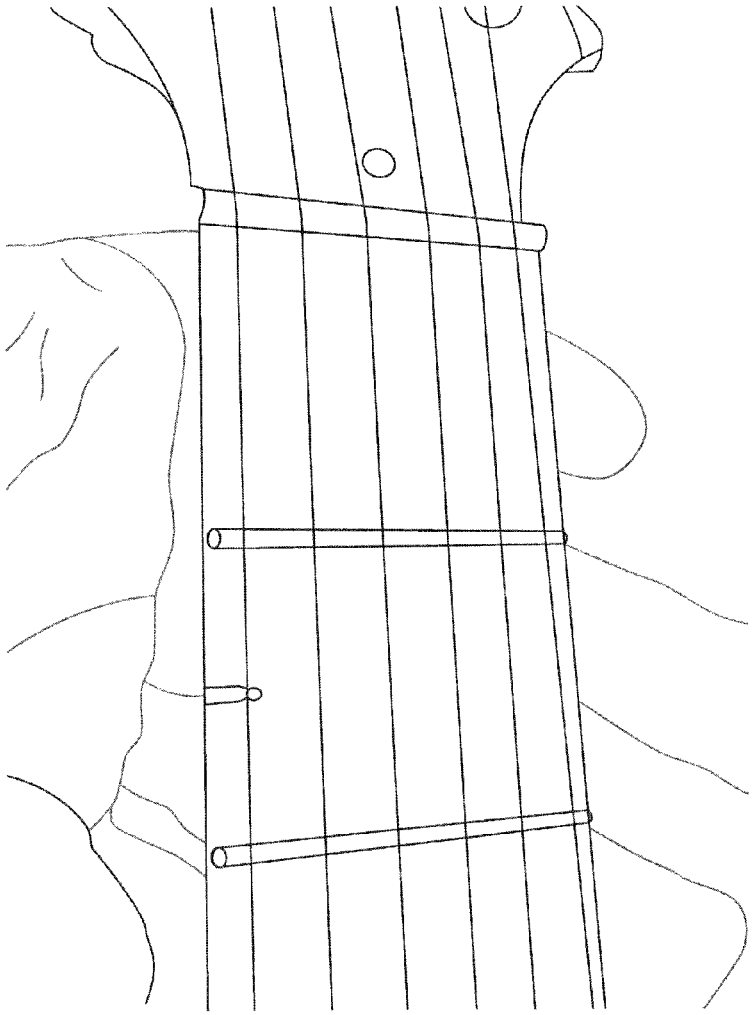
Figure 40:
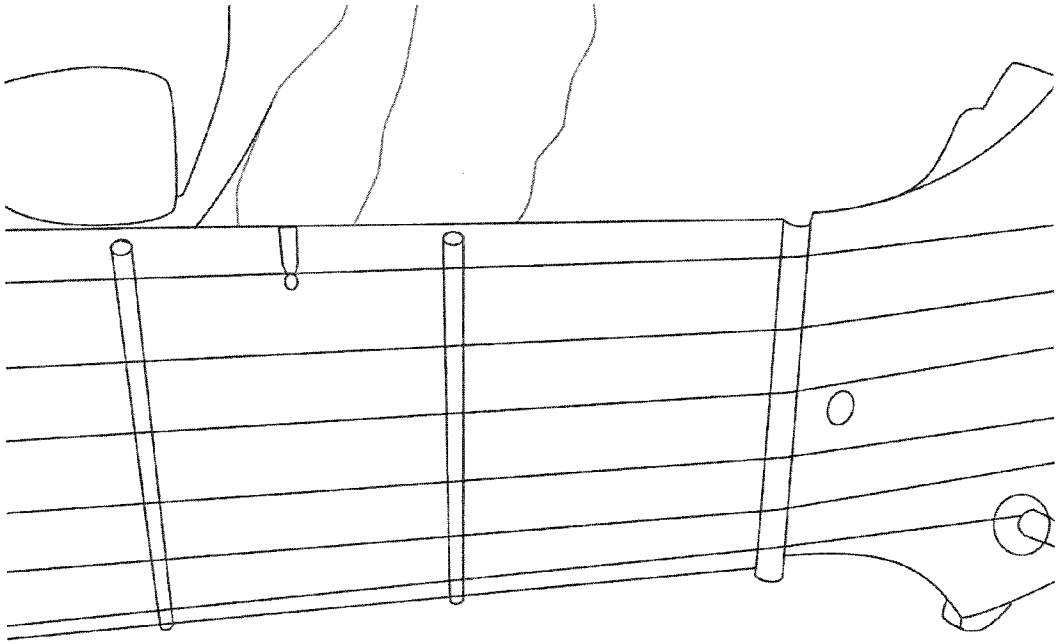
Figure 41:
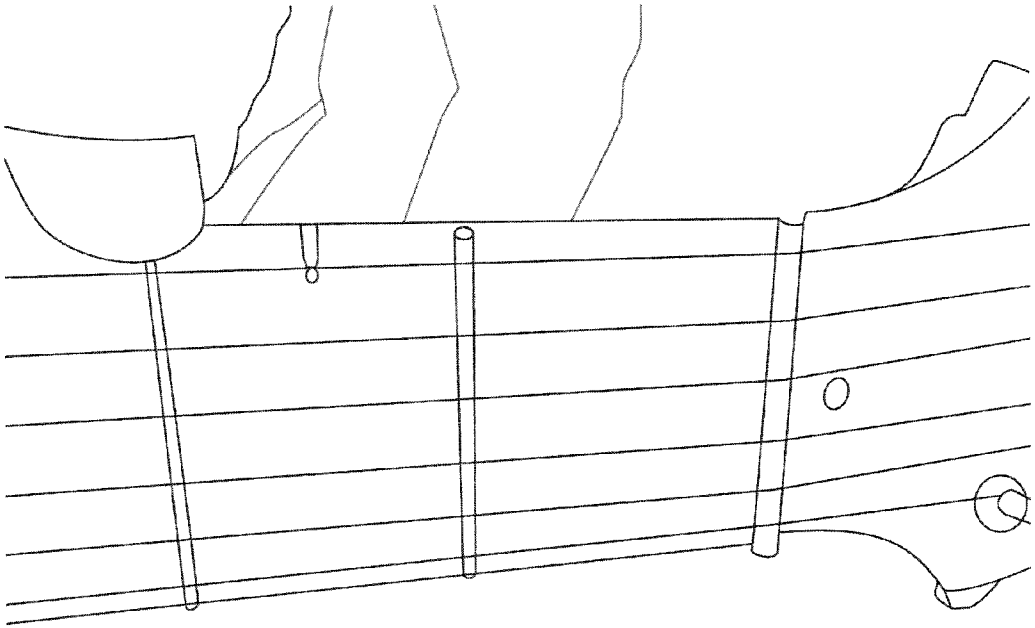
Figure 42:
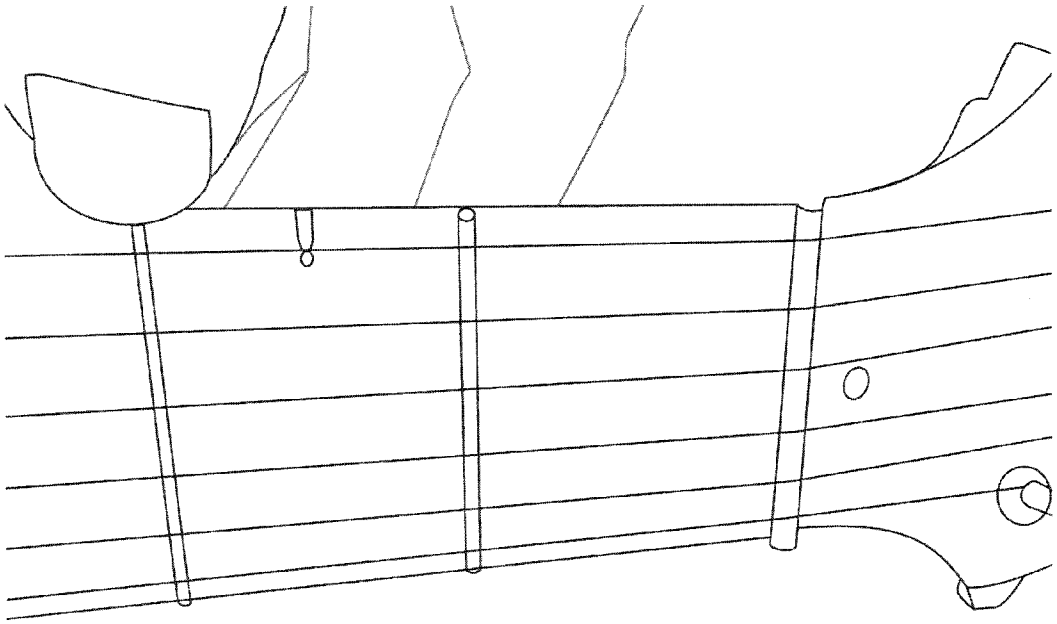
Figure 43:
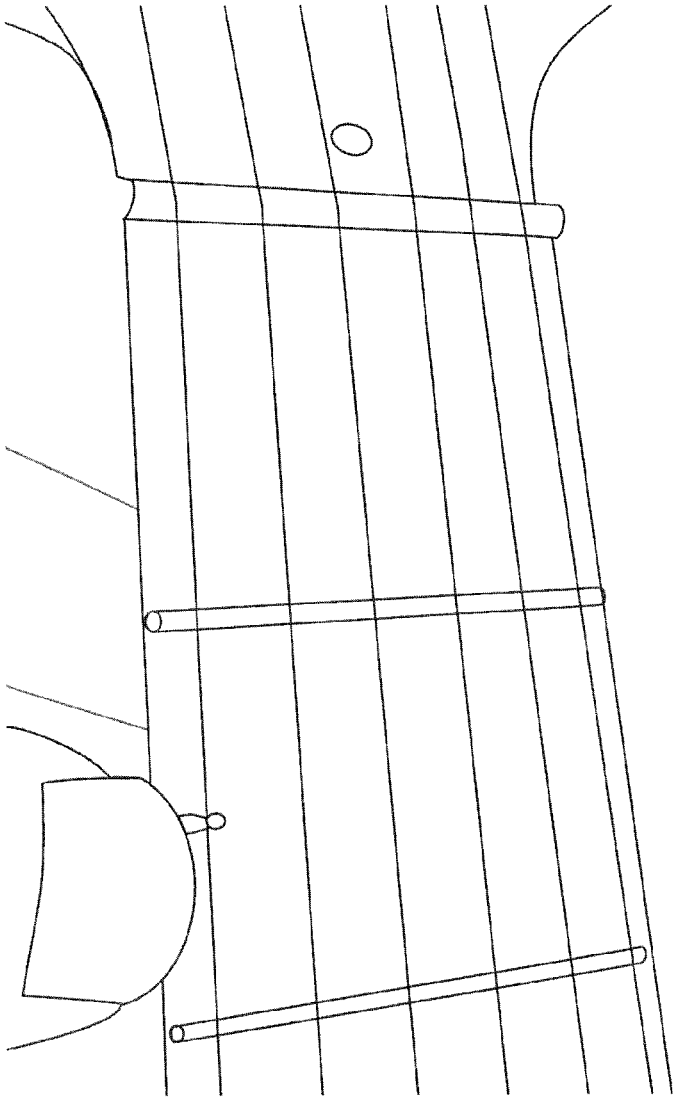
Figure 44:
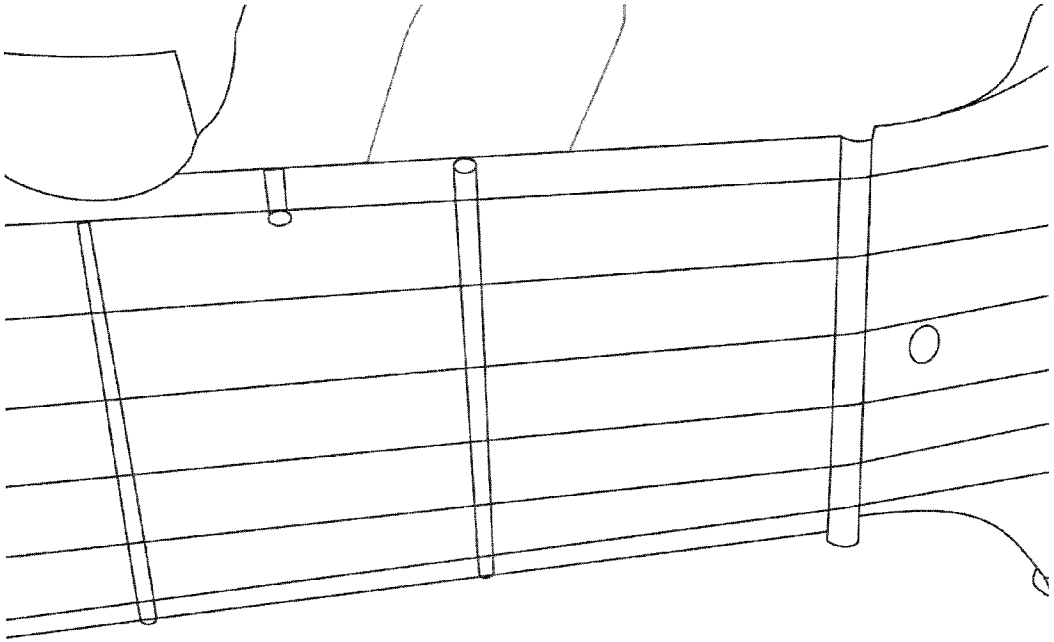
Figure 45:
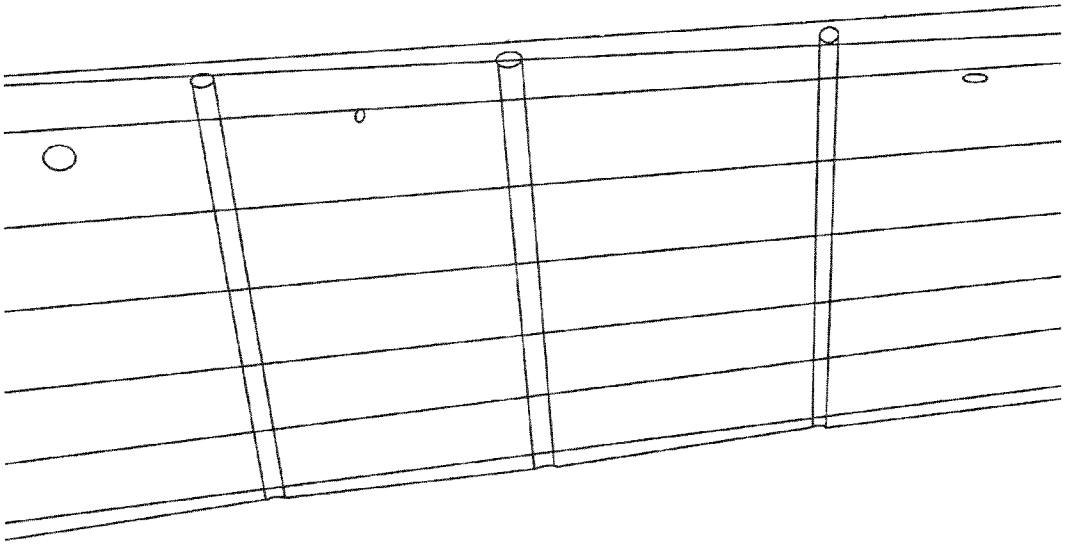
Figure 46:
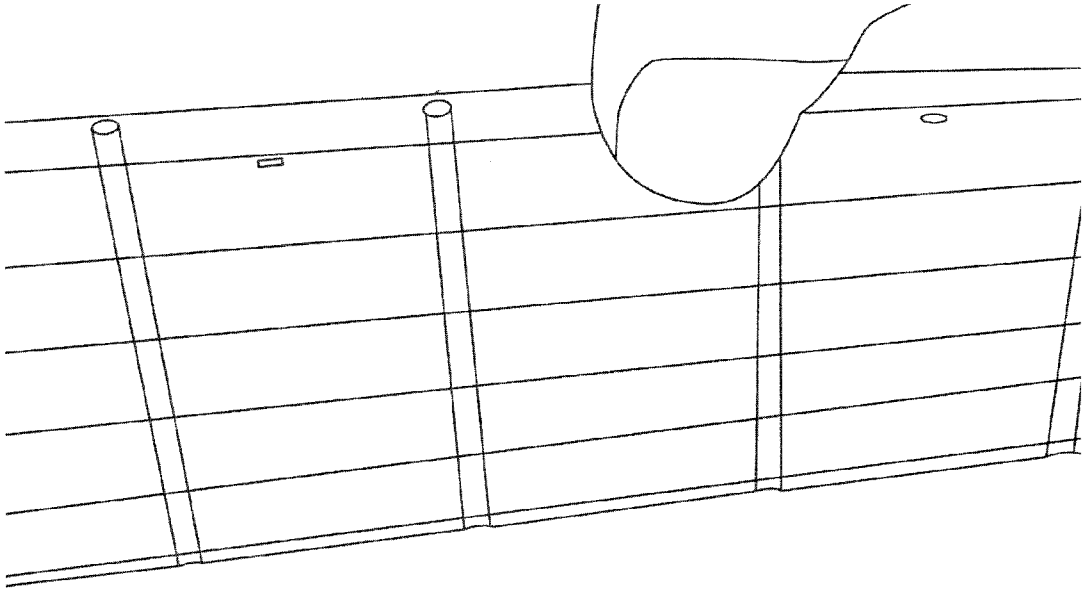
Figure 47:
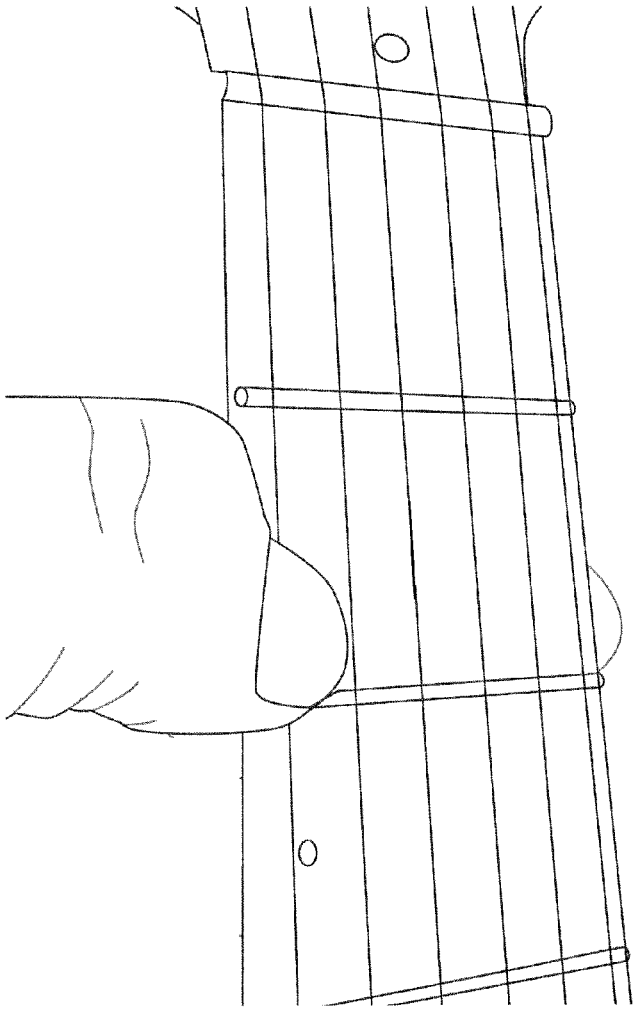
Figure 48:
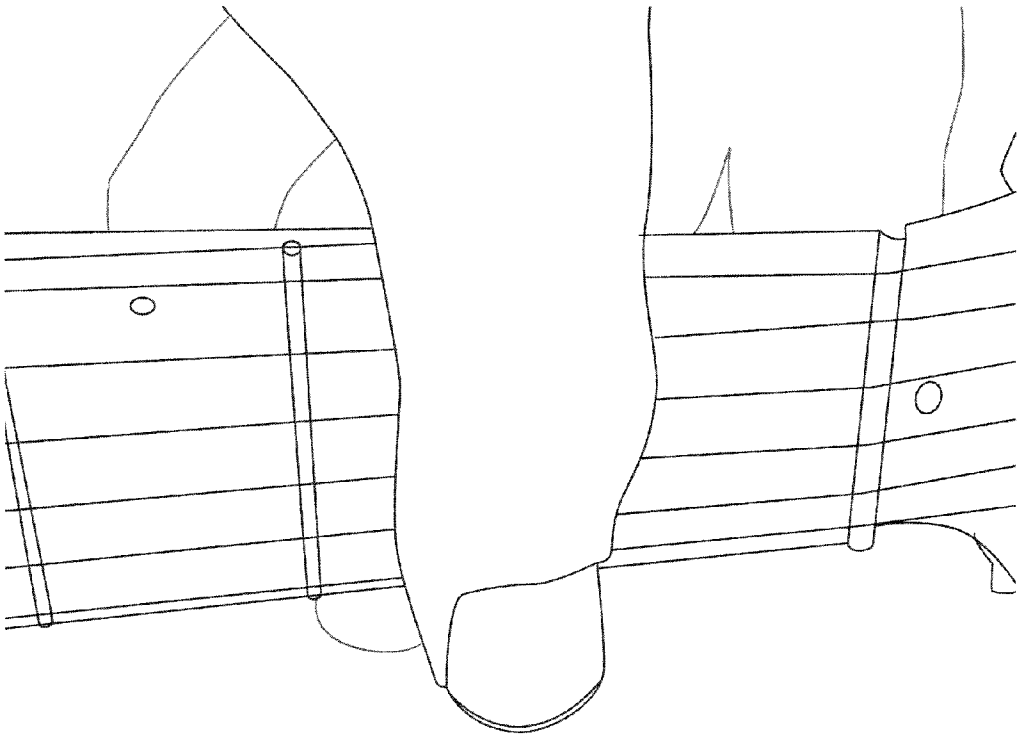
Figure 49:
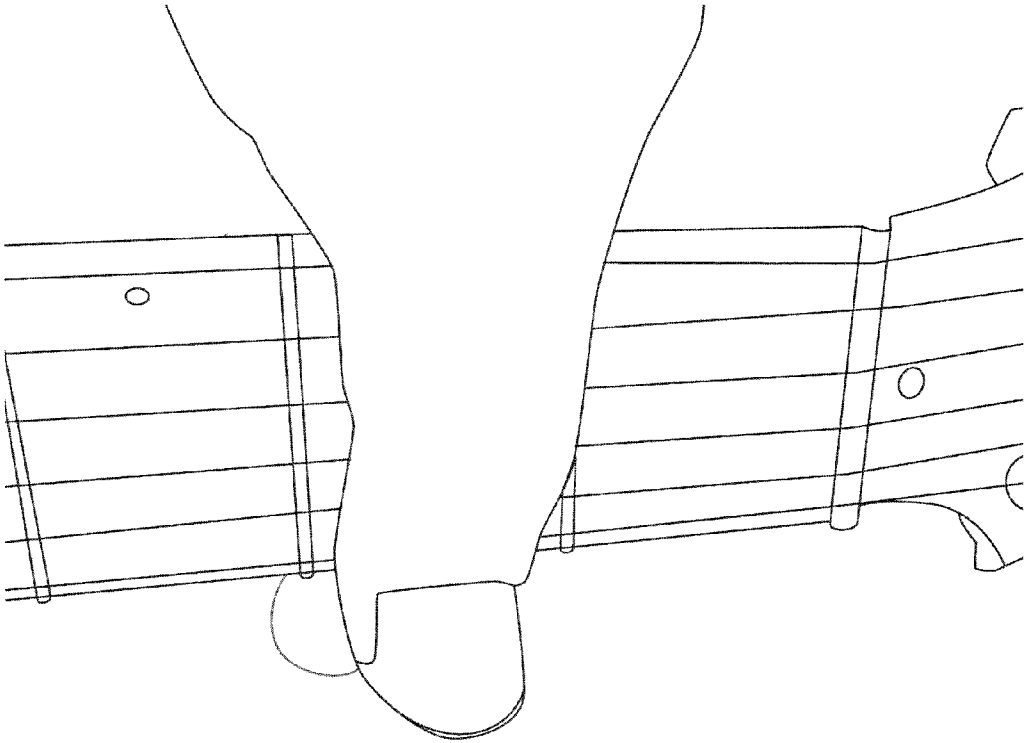
Figure 50:
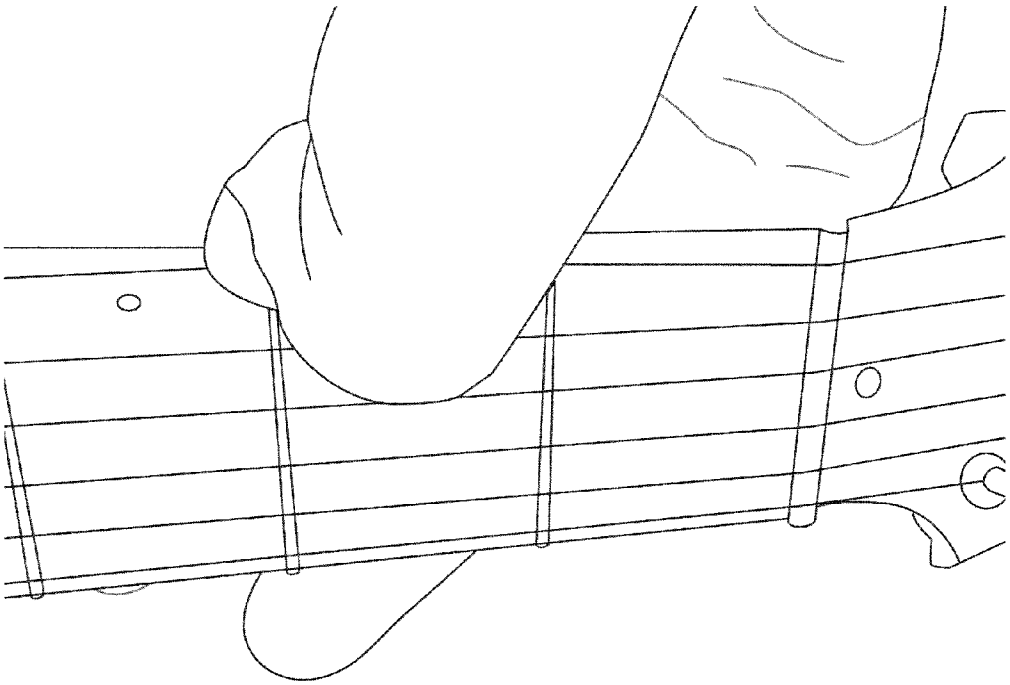
Figure 51:
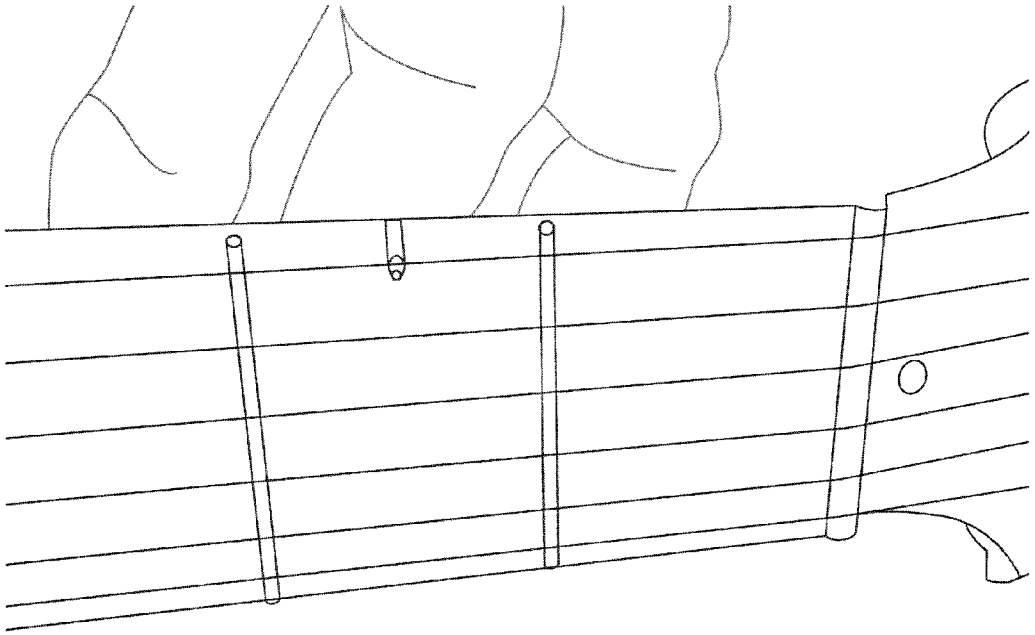
Figure 52:
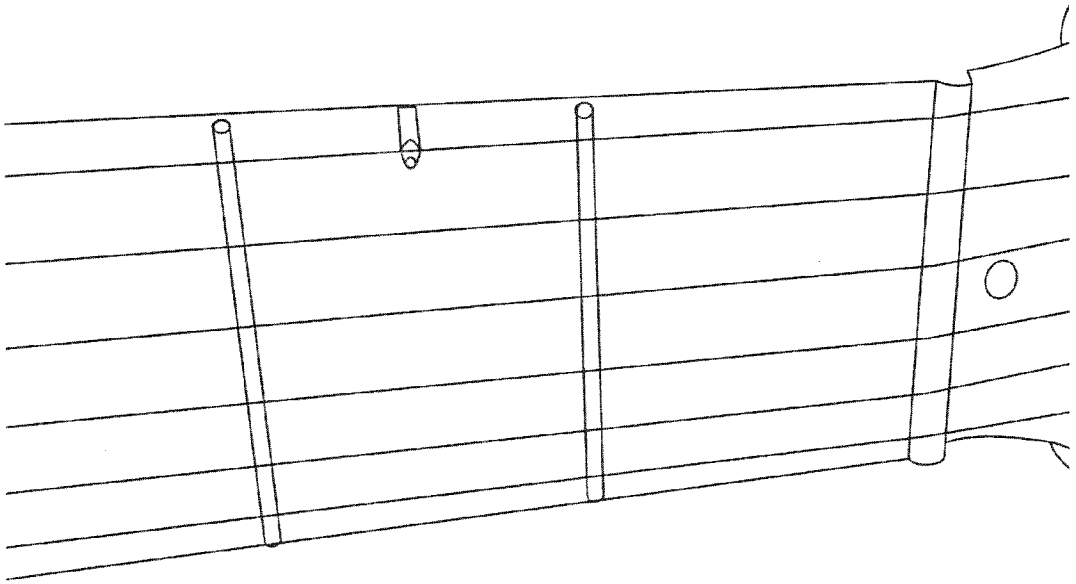
Figure 53:
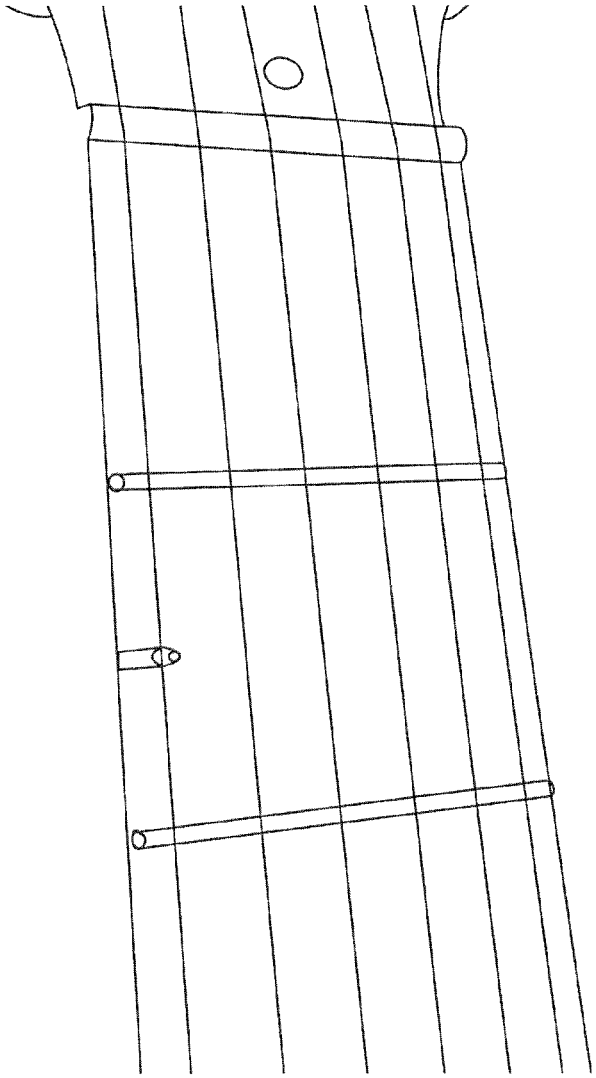

Referring to FIG. 7, in the exemplary embodiment depicted, the one or more spikes 200 are inserted between frets 124 of a particular string 112 of the plurality of strings 112. In the depicted embodiment, at least two spikes 200 are inserted between frets 124. One of the at least two spikes 200 is inserted into the fretboard 122 between the first and second frets 124 after the nut 126, and the other of the at least two spikes 200 is inserted into the fretboard 122 between the third and fourth frets 124 after the nut 126. This location was selected to facilitate playing in other keys and to utilize the interval of that string 112 relative to the others without having to retune the instrument 100. Both of the at least two spikes 200 are at the same time inserted near or under string 6 (which, after rearrangement in accordance with the invention, is the string 112 closest to the ceiling when one holds the stringed instrument 100 in one's lap). In the embodiment shown, the spikes 200 are inserted under string 6 so that string 6 can be easily disposed into the hooking portions 206 of the spikes 200. In some constructions, the spike 200 is inserted under a string 112 so that the elongated body 202 of the spike 200 protrudes approximately one string gauge so that the string 112 can be received between the fretboard 122 and the hooking end 206 of the spike 200. In FIGS. 1 and 2, at least one of the plurality of strings 112 can be made from ten (10) gauge string 112. Thus, the depicted spikes 200 may protrude a distance corresponding to a diameter of a ten gauge string so that the string 112 is received between the fretboard 122, a portion of the elongated body 202 protruding from the fretboard 122, and the hooking end 206 extending transversely from the elongated body 202. Furthermore, both spikes 200 protrude above the fretboard 122 only enough so that string 6 can still be fretted. In other words, the spike 200 should be inserted into the fretboard 122 so that the spike 200 does not protrude above a fret 124, or the spike 200 protrudes less than a height of one of the plurality of frets 124. Additionally, each spike 200 is preferably inserted approximately halfway between consecutive frets 124 so that the string 112 can still be fretted. That is, the distance between two consecutive or adjacent frets 124 should be determined, and the spike 200 should be preferably disposed in the approximate halfway point between the two consecutive or adjacent frets 124. Also, in the depicted embodiment, the spikes 200 are inserted approximately 3/16 of an inch from an outermost edge of the fretboard 122, as measured from the outermost edge of the fretboard 122 to a longitudinal center of the spike 200. The aforementioned dimensions are intended to be exemplary and are not intended to be limiting of the invention as eventually claimed.

When a string 112 is retained by at least one spike 200, the retained string 112 can have a higher pitch similar to a string of a banjo. Also, when the string 112 that is adapted to be retained by one or more spikes 200 is not retained by the one or more spikes 200, the string 112 can produce sound similar to an open first string of a guitar. Thus, the one or more spikes 200 can allow at least one string 112 to produce sound like a string of a banjo or produce sound like a string of a guitar. In other words, by retaining the at least one string 112, the one or more spikes 200 can change the harmonic interval of the at least one string 112 and allow the at least one string 112 to produce sound in two different keys, such as an "E" and a "C".

It should be noted that since the vibrating length of a retained string 112 may become shorter, the retained string 112 may become slightly sharp in sound. Therefore, the string 112 may need to be adjusted to compensate for the slightly sharper sound when the string 112 is retained by at least one of the spikes 200. For example, the following steps may be followed when preparing to use one of the spikes 200: first, tune the instrument; second, retain the 6th string 112 using one of the spikes 200; and third, tune the 6th string 112 to compensate for any sharpness that may have resulted from retaining the 6th string 112 with the spike 200. In the depicted embodiment, the string 112 that is adapted to be retained by at least one of the spikes 200 can be adjusted by use of its respective tuner 108 so that the sound of the string 112 to be retained is adjusted to be slightly flatter to compensate for the slight sharpness of the string 112 when the string 112 is retained by at least one of the spikes 200. Furthermore, ambient conditions, such as temperature, humidity, combinations of the aforementioned, or some other environmental influence on the plurality of strings 112 may affect the plurality of strings 112 such that an adjustment may not be necessary. For example, weather may affect the string 112 that is to be retained by at least one of the spikes 200 such that the string 112 does not become slightly sharper when the string 112 is retained by at least one of the spikes 200, and thereby make an adjustment of the string 112 to slightly flatten its sound unnecessary.

In operation, and with reference to FIGS. 8-53, a player of the stringed instrument 100 can place at least one of the plurality of strings 112 under one or more of the spikes 200. In this regard, one or more fingers of one hand can be used to place the at least one string 112 under one or more of the spikes 200 (e.g., between songs or at some other pause in playing of the instrument 100). For example, in FIGS. 8-53, one finger (the thumb) is used to push one string 112 under one spike 200 so that the one string 112 can be retained by one of the spikes 200. Although the string 112 can be retained by both of the spikes 200, the resulting sound produced by a string 112 retained by two spikes 200 can be too sharp. At least one of the strings 112 is placed under the hooking end 206 of the one or more spikes 200 and next to a portion of the elongated body 202 so that the at least one of the strings 112 is retained close to the fretboard 122. After the at least one string 112 is retained by at least one of the spikes 200, the retained string 112 can provide a sound generally similar to a string of a banjo, whereas when at least one string 112 was not retained by at least one of the spikes 200, the at least one string 112 could substantially provide the sound of a string of a guitar. Also, because the one or more spikes 200 are placed near the at least one string 112, the at least one string 112 can be quickly placed under one or more of the spikes 200. Thus, the transition from unretained string 112 to retained string 112 (or from a string 112 that can provide sound like a string of a guitar to a string 112 that can provide sound like a string of a banjo) can be made quickly by the player with just one finger and may be unnoticed by a listener or other observer.

With the components and construction described above, the stringed instrument 100 can provide at least the sounds of a guitar and a banjo. Thus, a player of the stringed instrument 100 can utilize the components of a guitar and produce the sound of a guitar and produce banjo type music from the same stringed instrument 100. When playing the stringed instrument 100, a player of the stringed instrument 100 can have immediate access to both a guitar repertoire and a banjo repertoire. In other words, the stringed instrument 100 can provide the superimposition of a banjo matrix and an open-tuned guitar matrix, where matrix refers to, for example, the various combinations of strings and frets (and/or the plurality of sounds arising therefrom). Thus, a banjo matrix and guitar matrix are available to the player at the same time, and a player may play the instrument 100 using the same strings 112 and frets 124 that a player would use when playing a banjo. Another advantage of the stringed instrument 100 is that the stringed instrument 100 can provide a banjo sound that can be amplified electronically. In this regard, because of the construction of a conventional banjo, the sound from a conventional banjo may not be easily amplified. This is because the drum head arrangement of a conventional banjo can act like a microphone diaphragm which can cause feedback when the banjo is being electronically amplified. The stringed instrument 100, however, can produce sounds of a banjo that can be electronically amplified without causing such feedback. Thus, the stringed instrument 100 allows banjo-type music to be played at a much higher volume than was previously possible. Also, a player of the stringed instrument 100 can produce guitar music from a banjo type framework provided by the stringed instrument 100.

Although described in connection with an exemplary embodiment thereof, it will be appreciated by those skilled in the art that additions, deletions, modifications, and substitutions not specifically described may be made without department from the spirit and scope of the invention as defined in the appended claims.

What is claimed is:

1. A stringed instrument, comprising:

a body;

a neck coupled to the body;

a plurality of strings extending from the body to a distal end of the neck, the plurality of strings arranged so that a thickest string and a thinnest string are adjacent to each other;

a plurality of frets disposed on the neck under at least one of the plurality of strings; and at least one spike disposed between two of the plurality of frets and under the at least one of the plurality of strings.

2. A stringed instrument according to claim 1, wherein the at least one spike includes an elongated body, a piercing end at one end of the elongated body, and a hooking end at another end of the elongated body.

3. A stringed instrument according to claim 1, wherein the at least one spike protrudes from the neck less than a height of one of the plurality of frets.

4. A stringed instrument according to claim 1, wherein the at least one spike includes:

an elongated body; and a hooking end at an end of the elongated body, the hooking end extending generally perpendicularly to a longitudinal length of the neck and away from a center of the neck.

5. A stringed instrument according to claim 1, wherein the at least one spike includes:

an elongated body; and a hooking end at an end of the elongated body, the hooking end extending generally perpendicularly to a longitudinal length of the neck and toward a center of the neck.

6. A stringed instrument according to claim 1, wherein the at least one spike includes:

an elongated body; and a hooking end at an end of the elongated body, wherein the at least one spike is filed near where the elongated body and the hooking end meet.

7. A stringed instrument according to claim 1, wherein the at least one spike includes:

an elongated body;

a hooking end at an end of the elongated body;

a corner formed where the elongated body meets the hooking end; and at least one of a groove, a slit, or a cavity disposed at the corner.

8. A stringed instrument according to claim 1, wherein the at least one spike is disposed approximately halfway between two adjacent frets of the plurality of frets.

9. A stringed instrument according to claim 1, wherein the at least one spike is disposed between a first fret and a second fret of the plurality of frets.

10. A stringed instrument according to claim 1, wherein the at least one spike is disposed between a third fret and a fourth fret of the plurality of frets.

11. A stringed instrument according to claim 1, wherein the neck comprises a fretboard, and wherein the at least one spike is disposed approximately 3/16 of an inch from an outermost edge of the fretboard.

12. A stringed instrument according to claim 1, wherein the thickest string and the thinnest string are near an outermost edge of the neck.

13. A stringed instrument according to claim 1, wherein the thickest string and the thinnest string are approximately two octaves apart.

14. A stringed instrument according to claim 1, wherein the thickest string and the thinnest string are E key strings approximately two octaves apart.

* * * * *